US008286455B2

(12) United States Patent
Fujii et al.

(10) Patent No.: US 8,286,455 B2
(45) Date of Patent: Oct. 16, 2012

(54) TRANSFORMABLE METAL SURFACE HARDENING METHOD

(75) Inventors: Hidetoshi Fujii, Osaka (JP); Yasufumi Yamaguchi, Osaka (JP); Toshitake Kanno, Shizuoka (JP); Yoya Fukuda, Shizuoka (JP)

(73) Assignees: Osaka University, Osaka (JP); Kimura Chuosho Co., Ltd., Shizuoka (JP)

( * ) Notice: Subject to any disclaimer, the term of this patent is extended or adjusted under 35 U.S.C. 154(b) by 1076 days.

(21) Appl. No.: 12/281,966

(22) PCT Filed: Jan. 15, 2007

(86) PCT No.: PCT/JP2007/050380

§ 371 (c)(1),
(2), (4) Date: Sep. 5, 2008

(87) PCT Pub. No.: WO2007/102280

PCT Pub. Date: Sep. 13, 2007

(65) Prior Publication Data

US 2009/0056404 A1 Mar. 5, 2009

(30) Foreign Application Priority Data

Mar. 8, 2006 (JP) ..... 2006-062274

(51) Int. Cl.
*B21D 17/04* (2006.01)

(52) U.S. Cl. ..... 72/75; 72/67; 72/69; 72/112

(58) Field of Classification Search ..... 72/67, 69, 72/75, 112, 115, 126; 228/2.1, 2.3, 112.1, 228/114.5

See application file for complete search history.

(56) References Cited

U.S. PATENT DOCUMENTS

2001/0038028 A1* 11/2001 Iwashita ..... 228/112.1

FOREIGN PATENT DOCUMENTS

| | | | |
|---|---|---|---|
| JP | 5078511 A | | 6/1975 |
| JP | 50078513 A | * | 6/1975 |
| JP | 05230536 | | 9/1993 |
| JP | 08311636 | | 11/1996 |

(Continued)

OTHER PUBLICATIONS

Machine translation of JP2004-176149A (Toyota), pp. 1-8.*

(Continued)

*Primary Examiner* — Teresa M Ekiert
(74) *Attorney, Agent, or Firm* — Armstrong Teasdale LLP

(57) ABSTRACT

A method of metal surface hardening treatment inducing transformation, in which transformation is induced in a surface interior of material as hardening treatment object by simple, rapid treatment utilizing a frictional heat under pressure without the occurrence of melt loss, quench crack, soft spot, deformation, etc. to thereby reform the structure of surface interior of material as hardening treatment object into a miniaturized martensitic structure. The method of surface hardening treatment comprised the steps of while rotating nearly cylindrical pressurization tool (2) at high velocity, pressing the bottom face thereof slightly into the surface of material as hardening treatment object (1) so as to attain application of given pressure, thereby generating a local frictional hear between the pressurization tool and the material as hardening treatment object; inducing transformation in the material as hardening treatment object at the locality having been exposed to the frictional heat; and when the surface of material as hardening treatment objent positioned in the vicinity of the pressurization tool starts to soften by the frictional heat, moving the pressurization tool.

15 Claims, 24 Drawing Sheets

FOREIGN PATENT DOCUMENTS

| | | | |
|---|---|---|---|
| JP | 1192822 | A | 4/1999 |
| JP | 11131182 | | 5/1999 |
| JP | 11286715 | A | 10/1999 |
| JP | 2001314983 | A | 11/2001 |
| JP | 200296183 | A | 4/2002 |
| JP | 2002372382 | | 12/2002 |
| JP | 2003136256 | A | 5/2003 |
| JP | 2004176149 | A | 6/2004 |
| JP | 2005002445 | | 1/2005 |
| JP | 2005307307 | | 11/2005 |
| WO | 9310935 | | 6/1993 |
| WO | 9510935 | | 4/1995 |

OTHER PUBLICATIONS

International Search Report for PCT/JP2007/050380, dated Mar. 20, 2007, 5 pages.

* cited by examiner (a)

| | −10 | −8 | −6 | −4 | −2 | 0 | 2 | 4 | 6 | 8 | 10 |
|---|---|---|---|---|---|---|---|---|---|---|---|
| 0 | 332.4 | 540.2 | 635.8 | 456.5 | 510.5 | 362.1 | 458.1 | 372.5 | 492.1 | | 299.3 |
| 0.1 | 316.1 | 550.6 | 447.1 | 544.3 | 607.8 | 514.3 | 536.1 | 832.9 | 243.6 | | 291.4 |
| 0.2 | 300.1 | 660.2 | 605.3 | 586.2 | 602.9 | 882.3 | 617.8 | 848.9 | 550.6 | | 313.3 |
| 0.3 | 295.9 | 600.5 | 701.0 | 554.9 | 544.3 | 464.6 | 423.2 | 735.7 | 802.2 | 431.9 | 315.2 |
| 0.4 | 296.7 | | 805.9 | 439.4 | 873.8 | 583.6 | 704.0 | | 565.8 | | 291.4 |
| 0.5 | | 565.8 | 873.8 | 610.3 | | 719.6 | 904.3 | 739.0 | 819.5 | 665.8 | 237.7 |
| 0.6 | | 405.2 | 716.4 | 895.4 | 554.9 | 526.0 | 697.9 | 602.9 | 802.2 | 492.1 | |
| 0.7 | 248.3 | 508.6 | 735.7 | | 886.7 | 869.6 | 674.3 | 633.2 | 882.3 | | 273.8 |
| 0.8 | 255.4 | 459.7 | 686.0 | 325.5 | 891.0 | 802.2 | | 745.7 | 742.3 | 241.3 | 226.6 |
| 0.9 | | 343.6 | 729.2 | 674.3 | 755.8 | 802.9 | 756.8 | 534.1 | | 328.5 | 319.8 |
| 1 | | 355.4 | 506.8 | 638.4 | 798.5 | 593.3 | 627.0 | 882.3 | 339.5 | 485.0 | |
| 1.1 | | | | 612.7 | 739.0 | 927.0 | 922.4 | | 405.2 | 379.7 | 274.8 |
| 1.2 | | 308.8 | 421.8 | 590.9 | 630.6 | 840.8 | 882.3 | | | 456.5 | 313.3 |
| 1.3 | | 412.0 | | | 882.3 | 540.2 | 783.8 | | 461.4 | | 252.8 |
| 1.4 | | 335.4 | | 522.1 | 857.1 | 610.3 | 891.9 | 791.1 | 490.3 | 285.3 | |

(b)

(c)

(a)

| | -6 | -4 | -2 | 0 | 2 | 4 | 6 | 8 |
|---|---|---|---|---|---|---|---|---|
| 0 | | 635.8 | 628.0 | 331.4 | 722.8 | 399.9 | 331.4 | |
| 0.1 | 869.6 | 878.1 | 908.7 | 426.1 | 809.7 | | 343.6 | 371.3 |
| 0.2 | 798.5 | | 848.9 | 317.0 | 739.0 | 351.1 | 267.2 | |
| 0.3 | 861.2 | | 802.2 | 287.7 | 752.4 | 817.3 | 473.0 | 257.5 |
| 0.4 | 832.9 | | 595.7 | 520.1 | 508.8 | | 320.8 | 283.7 |
| 0.5 | 586.2 | | 745.7 | 588.6 | 630.8 | 361.0 | 339.5 | 192.4 |
| 0.6 | 399.9 | 752.4 | 451.7 | 620.3 | 319.8 | 205.3 | | 197.3 |
| 0.7 | 538.1 | | 766.1 | 794.8 | 595.7 | | 376.1 | 230.0 |
| 0.8 | 396.0 | | 844.8 | 857.1 | 570.3 | 285.3 | 254.8 | 202.9 |
| 0.9 | 686.0 | | 735.7 | 372.5 | 369.0 | 392.2 | 271.6 | 244.4 |
| 1 | | | 394.7 | 445.5 | | | 334.4 | 236.5 |

(b)

(c)

(a)

| | -10 | -9 | -8 | -7 | -6 | -5 | -4 | -3 | -2 | -1 | 0 | 1 | 2 | 3 | 4 | 5 | 6 | 7 | 8 | 9 | 10 |
|---|---|---|---|---|---|---|---|---|---|---|---|---|---|---|---|---|---|---|---|---|---|
| 0.0 | | 495.7 | 522.1 | 524.1 | 431.9 | 327.5 | 291.8 | 167.1 | 189.8 | 184.3 | 206.3 | 171.9 | 314.3 | 219.0 | 437.9 | 510.5 | 638.4 | 610.3 | 610.3 | 403.9 | 136.6 |
| 0.1 | 571.4 | | 913.3 | 861.2 | 913.3 | 857.1 | 694.9 | 722.8 | 499.4 | 458.1 | 503.0 | 805.9 | 668.6 | 749.0 | 794.8 | 832.9 | 832.9 | | 471.3 | 522.1 | 390.9 |
| 0.2 | | 211.2 | | 878.1 | | | 853.0 | | 479.8 | 466.3 | 447.1 | 488.5 | 828.9 | | 848.9 | | 766.1 | 689.0 | 686.0 | 583.9 | 315.2 |
| 0.3 | 665.8 | 720.0 | | 865.4 | | 857.1 | 882.3 | 805.9 | 780.2 | 430.5 | 459.7 | 503.6 | | 729.2 | 798.5 | | 787.5 | 463.0 | 778.7 | | |
| 0.4 | | 773.1 | 802.2 | | | 792.7 | 840.8 | 832.9 | | 467.9 | 548.5 | 448.6 | | 817.3 | 825.0 | 719.6 | 739.0 | | 729.2 | | 273.1 |
| 0.5 | | 546.4 | 654.6 | 848.9 | 857.1 | 853.0 | 729.2 | 861.2 | 853.0 | 469.6 | 461.4 | 416.2 | 722.9 | 780.2 | | | 615.2 | 421.8 | | 504.9 | |
| 0.6 | | | | 828.9 | 865.4 | | | | 780.2 | 419.0 | 476.4 | 506.8 | 719.6 | 680.1 | 776.7 | | | | 442.4 | 308.0 | |
| 0.7 | 327.5 | | | 878.1 | 661.9 | 776.7 | 932.9 | 873.6 | 762.7 | 405.2 | 451.7 | 466.3 | 817.3 | 783.8 | 691.9 | 735.7 | | 652.8 | 540.2 | | 344.7 |
| 0.8 | | 398.6 | 739.0 | | 857.1 | 922.4 | 780.2 | 828.9 | 913.3 | 382.1 | 372.5 | 396.0 | | 776.7 | | 755.8 | 683.0 | | 358.5 | 350.0 | 309.7 |
| 0.9 | | 522.1 | 464.6 | 442.4 | 710.2 | 593.3 | 612.7 | 817.3 | | 369.0 | 384.6 | 454.9 | 805.9 | 794.8 | 588.0 | 825.0 | | | | 392.7 | |
| 1.0 | | 167.5 | 407.9 | 339.5 | 325.5 | 334.4 | | 486.8 | 421.8 | | 504.9 | 518.2 | | 559.2 | 722.8 | | 407.9 | | 410.6 | 362.1 | |
| 1.1 | | 220.6 | 302.7 | 488.5 | | 461.4 | | | 552.8 | 436.4 | 577.0 | 512.4 | | 323.0 | 308.0 | | | 263.0 | | 227.8 | 188.1 |
| 1.2 | 197.8 | 213.2 | 240.7 | 301.0 | 298.4 | 203.4 | 406.6 | 283.7 | 534.1 | | 338.4 | 319.8 | 243.8 | 229.5 | 241.9 | 369.0 | 254.1 | 270.1 | | | |
| 1.3 | 209.1 | 240.1 | | 281.4 | 371.3 | 431.8 | 536.1 | 281.4 | 550.6 | 643.8 | 683.0 | 362.1 | | 290.9 | 447.1 | 203.4 | 314.3 | 295.1 | 398.8 | 250.2 | |
| 1.4 | 201.5 | 211.2 | 278.3 | 410.6 | | 286.1 | | 228.9 | | 406.6 | 413.4 | 479.8 | 318.9 | 305.5 | 333.4 | 276.8 | 234.7 | | 192.4 | 245.7 | 220.1 |
| 1.5 | 203.4 | | | 377.3 | 476.4 | 448.6 | 561.4 | 817.3 | 476.1 | 563.6 | 568.0 | 633.2 | 346.8 | 485.0 | | 347.8 | | 362.1 | | 276.3 | 242.5 |

(b)

(c)

(a)

| | -10 | -8 | -6 | -4 | -2 | 0 | 2 | 4 | 6 | 8 |
|---|---|---|---|---|---|---|---|---|---|---|
| 0 | 763.1 | 774.5 | 569.7 | | 430.5 | 348.9 | 674.3 | 612.7 | 610.3 | 297.6 |
| 0.1 | 792.2 | 795.2 | 630.7 | 869.6 | 598.1 | 379.7 | 579.3 | 610.3 | | 320.8 |
| 0.2 | 736.3 | 819.8 | 661.6 | 749.0 | | 374.9 | | 848.9 | | 313.3 |
| 0.3 | 771.7 | 908.2 | 872.5 | 849.9 | 586.4 | 501.2 | 677.2 | 716.4 | 848.9 | |
| 0.4 | 650.2 | 826.1 | 835.7 | 927.0 | 716.4 | 641.1 | 857.1 | 707.1 | 665.8 | |
| 0.5 | 584.5 | 839.0 | 915.6 | 826.1 | 832.9 | 424.7 | 742.3 | 853.0 | 713.3 | |
| 0.6 | 509.3 | 795.2 | 822.9 | 873.8 | 376.1 | 403.9 | 513.9 | 742.3 | 810.4 | 331.4 |
| 0.7 | 335.0 | 882.3 | 668.4 | 917.8 | 806.7 | 417.6 | 383.4 | 742.3 | 704.0 | 226.5 |
| 0.8 | 326.9 | 904.5 | 796.2 | 882.3 | 802.2 | 765.9 | 774.5 | 745.7 | 828.9 | |
| 0.9 | | 620.2 | 732.9 | 739.0 | 817.3 | 298.4 | 550.6 | 410.6 | | 389.6 |
| 1.0 | 303.7 | 751.9 | 628.5 | 697.9 | 562.8 | 881.2 | 716.4 | 683.0 | 287.7 | 293.4 |
| 1.1 | | | 436.5 | 759.2 | 791.1 | 538.1 | 654.6 | | 665.8 | 141.7 |
| 1.2 | 266.4 | 430.4 | 630.7 | 735.7 | 717.2 | 621.2 | 749.0 | 394.7 | 306.2 | |
| 1.3 | | | | | 697.9 | | 683.0 | 493.9 | 399.9 | 213.8 |
| 1.4 | | | 501.7 | 735.6 | 776.7 | 620.3 | | 439.4 | | |

(b)

(c)

(a)

| | -8 | -6 | -4 | -2 | 0 | 2 | 4 | 6 | 8 |
|---|---|---|---|---|---|---|---|---|---|
| 0 | 518.2 | 654.6 | 769.6 | 554.9 | 508.6 | 552.8 | 565.8 | 691.9 | 791.1 |
| 0.1 | 762.7 | 716.4 | 532.0 | 504.9 | 416.2 | 463.0 | 660.2 | 766.1 | 716.4 |
| 0.2 | 869.6 | 646.5 | 548.5 | 735.7 | 710.2 | 713.3 | 683.0 | 622.8 | 691.9 |
| 0.3 | 828.9 | 735.7 | 749.0 | 701.0 | 716.4 | 583.9 | 836.8 | 694.9 | 763.8 |
| 0.4 | 707.1 | 794.8 | 729.2 | 719.6 | 677.2 | 617.8 | 832.9 | 832.9 | 694.9 |
| 0.5 | 660.2 | 710.2 | 719.6 | 716.4 | 364.4 | 654.6 | 638.4 | 732.5 | 791.1 |
| 0.6 | | 654.6 | 688.9 | 694.9 | 654.6 | 612.7 | 729.2 | 742.3 | 710.2 |
| 0.7 | 532.0 | 598.1 | 630.6 | 686.0 | 735.7 | 739.0 | 607.8 | 745.7 | 710.2 |
| 0.8 | 516.3 | 635.8 | 691.9 | 628.0 | 668.6 | 651.9 | 713.3 | 769.6 | 528.0 |
| 0.9 | 423.2 | 561.4 | 617.8 | 548.5 | 524.1 | 766.1 | 495.7 | 520.1 | 610.3 |
| 1.0 | | 595.7 | 520.1 | 600.5 | 508.6 | 766.1 | 561.4 | 538.1 | 590.9 |
| 1.1 | 402.6 | 540.2 | 499.4 | 598.1 | 546.4 | 663.0 | 572.5 | 546.4 | 476.4 |
| 1.2 | 387.1 | 593.3 | 459.7 | 469.6 | 554.9 | 704.0 | 430.5 | 324.6 | 371.3 |
| 1.3 | 370.2 | 351.1 | 471.3 | 478.1 | 476.4 | 617.8 | 612.7 | 528.0 | 390.9 |
| 1.4 | | 522.1 | 389.6 | 463.0 | 532.0 | 735.7 | 445.5 | 479.8 | 339.5 |

(b)

(c)

(a)

| | -8 | -6 | -4 | -2 | 0 | 2 | 4 | 6 | 8 | 10 |
|---|---|---|---|---|---|---|---|---|---|---|
| 0 | 825.0 | 762.7 | 598.6 | 563.6 | 633.2 | 524.1 | 710.2 | 686.0 | 466.3 | 191.5 |
| 0.1 | 612.7 | 530.0 | 538.1 | 565.8 | 534.1 | 493.9 | 486.8 | 524.1 | 641.1 | 276.8 |
| 0.2 | 615.2 | 622.8 | 668.6 | 617.8 | 546.4 | 524.1 | 508.6 | 497.5 | 488.5 | 218.4 |
| 0.3 | 766.1 | 817.3 | 865.4 | 809.7 | 688.9 | 605.3 | 530.0 | 469.6 | 479.8 | 200.5 |
| 0.4 | 794.8 | 873.8 | 769.6 | 710.2 | 732.5 | 722.8 | 602.9 | 635.8 | 565.8 | 216.3 |
| 0.5 | 759.2 | 857.1 | 821.2 | 853.0 | 805.9 | 716.4 | 691.9 | 680.1 | 654.6 | 208.2 |
| 0.6 | 633.2 | 832.9 | 809.7 | 809.7 | 776.7 | 701.0 | 663.0 | 586.2 | 617.8 | 222.2 |
| 0.7 | 660.2 | 805.9 | 809.7 | 836.8 | 780.2 | 732.5 | 704.0 | 697.9 | 610.3 | 208.7 |
| 0.8 | 508.6 | 805.9 | 825.0 | 840.8 | 832.9 | 729.2 | 686.0 | 674.3 | 595.7 | 206.7 |
| 0.9 | 503.0 | 713.3 | 773.1 | 848.9 | 805.9 | 782.7 | 732.5 | 691.9 | 574.7 | 205.3 |
| 1 | 486.8 | 773.1 | 821.2 | 853.0 | 817.3 | 749.0 | 722.8 | 701.0 | 524.1 | 203.8 |
| 1.1 | 488.5 | 773.1 | 853.0 | 825.0 | 787.5 | 719.6 | 707.1 | 660.2 | 499.4 | 207.7 |
| 1.2 | 350.0 | 665.8 | 622.8 | 607.8 | 805.9 | 726.0 | 704.0 | 663.0 | 524.1 | 212.2 |
| 1.3 | 279.1 | 590.9 | 688.9 | 683.0 | 719.6 | 651.9 | 628.0 | 593.3 | 445.5 | 184.3 |
| 1.4 | 286.9 | 713.3 | 821.2 | 773.1 | 704.0 | 665.8 | 622.8 | 561.4 | 331.4 | 179.9 |

FIG. 18

| | -9 | -6 | 3 | 0 | 3 | 6 | 9 |
|---|---|---|---|---|---|---|---|
| FC300-0mm① | 41.5 | 48.8 | 46.7 | 37.4 | 48.8 | 41.2 | 19.8 |
| | 49.4 | 46.7 | 47.5 | 39.5 | 49.4 | 49.3 | 35.0 |
| FC300-0mm② | 51.6 | 51.4 | 42.5 | 46.8 | 47.0 | 42.8 | 33.5 |
| | 48.5 | 51.8 | 43.4 | 40.0 | 50.5 | 47.3 | 46.8 |
| FCD700-1.5mm① | 32.3 | 55.4 | 43.0 | 42.0 | 51.5 | 53.1 | 44.2 |
| | 44.5 | 56.1 | 50.2 | 45.4 | 54.5 | 60.5 | 58.3 |
| FCD700-0mm① | | 46.4 | 53.8 | 20.0 | 52.6 | 51.9 | |
| | | 47.3 | 58.3 | 31.8 | 58.7 | 56.7 | |
| FCD700-0mm② | | 40.6 | 47.0 | 40.5 | 46.0 | 35.3 | |
| | | 46.8 | 47.5 | 34.8 | 45.8 | 49.0 | |
| HMD5-0mm | 32.3 | 55.4 | 43.0 | 42.0 | 51.5 | 53.1 | 44.2 |
| | 44.5 | 56.1 | 50.2 | 45.4 | 54.5 | 60.5 | 58.3 |

TRANSFORMABLE METAL SURFACE HARDENING METHOD

TECHNICAL FIELD

The present invention relates to a metal surface hardening method and particularly to a surface hardening method for applying friction and/or stirring to a transformable metal surface to improve the metal surface property.

BACKGROUND TECHNOLOGY

Conventionally, various surface hardening methods are used to increase the surface hardness and to improve the abrasion resistance of iron and steel parts such as press dies and slide members and gears of machining tools.

The conventional surface hardening method for metal materials such as iron and steel includes pack carburizing, gas carburizing, liquid carburizing, high frequency quenching, flame hardening, plating, and nitriding.

Generally, the surface quenching is extensively used for hardening the surface of metal materials such as iron and steel. The conventional steel quenching is a modification (hardening) process in which a quenching object is heated to a temperature (800 to 1,300° C.) at which the inner solid solution body transforms to an austenitic structure with a face-centered cubic crystal structure and quenched to prevent transformation to ferrite, perlite, or bentonite, whereby a martensitic structure with a needle crystal structure consisting of fine plate or lenticular crystal is obtained in the austenitic structure. This process is named differently depending on the heating source.

Examples of the surface quenching include flame hardening, high frequency quenching, electron beam quenching, and laser quenching.

In flame hardening, the surface of an object to be quenched is heated to a specific temperature with acetylene and oxygen gas using a burner and then quenched. The flame hardening requires no special equipment but has a drawback that in the case of manual operation, the heating temperature cannot be controlled with accuracy and a skill is required to form a uniform hardened layer. Because of such high dependency on the operator's skill, flame hardening is considered to be beneficial for objects to be quenched having complex shapes such as gears and inefficient and inappropriate for objects to be quenched objects having simple shapes such as slide members of machining tools (see Patent Documents 1, 2, and 3 below).

In high frequency quenching, an object to be quenched is heated to a specific temperature using heat generated by a high frequency eddy current induced by electromagnetic induction and then quenched. This method utilizes such characteristic that the induced current is maximized on the surface of the object to be quenched and decreased toward the inner part thereof. Advantageously, the quenching property can efficiently be controlled by using a proper combination of frequency to induce an eddy current, material and shape of a heating coil, and cooling system according to the object to be quenched. However, this method has poor versatility (see Patent Documents 4, 5, and 6 below).

In electron beam quenching, an object to be quenched is heated to a specific temperature using an electric beam and then quenched. The quenching process is performed in vacuum which requires expensive equipment.

In laser quenching, an object to be quenched is heated to a specific temperature using a laser and then quenched. The laser quenching also requires expensive equipment like the electron beam quenching. Furthermore, it requires a troublesome task of applying absorbent such as graphite to the surface of an object to be quenched because a metallic object to be quenched reflects the laser.

In addition, Patent Documents 7 and 8 are referred to here, which relate to metal joint and disclose techniques to apply friction and stirring to metal as in the present invention although they are essentially different in purpose from the present invention relating to a metal surface hardening method and they utilize apparently different tools.

Patent Document 1: Japanese Laid-Open Patent Application Publication No. H05-230536;

Patent Document 2: Japanese Laid-Open Patent Application Publication No. H08-311636;

Patent Document 3: Japanese Laid-Open Patent Application Publication No. H11-131182;

Patent Document 4: Japanese Laid-Open Patent Application Publication No. 2002-372382;

Patent Document 5: Japanese Laid-Open Patent Application Publication No. 2005-2445;

Patent Document 6: Japanese Laid-Open Patent Application Publication No. 2005-307307;

Patent Document 7: International Application Publication WO93/10935; and

Patent Document 8: International Application Publication WO95/10935.

DISCLOSURE OF THE INVENTION

Problems Overcome by the Invention

The above conventional methods are all common in that heat is compulsively provided to an object to be quenched from outside. Such compulsive heating leads to the following common possible problems and defects:

- Loss of volume: An object to be quenched melts because of overheating (melt loss). In the conventional quenching, higher quenching temperatures tend to yield a higher hardness. Therefore, overheating may cause the quenching object to melt.
- Larger crystal grains: In some of objects to be hardened, crystal grains may grow larger and a hardened layer may become brittle.
- Quenching crack: a quenched object may have cracks as a result of thermal stress caused by internal/external temperature differences upon quick heating and cooling and/or transformation stress caused by abnormal expansion accompanying martensitic transformation. This phenomenon is a fatal flaw to an quenched object.
- Soft spot: a quenched object may have local hardness excessively high or low as a result of improper temperature control that causes the quenching object to be heated partly to higher or lower temperatures than a specific temperature.
- Deformation/distortion: An object to be quenched has a complex shape and is subject to local differences in the added heat quantity and cooling speed. Portions subject to different temperatures undergo some thermal stress. This stress and the transformation stress together affect the measurements of the quenched object in a complex manner such as expanding, shrinking, or deforming.

The present invention has been made under the above circumstances and provides a novel metal surface hardening method that radically resolves the above prior art problems and drawbacks. The surface hardening method of the present invention is a transformable metal surface hardening method for transforming the surface portion of an object to be hardened in a simple and quick process using frictional heat under pressure to modify the surface micro structure of the object to a fine martensitic structure.

Means for Solving Problem

The first aspect of the present invention provides a transformable metal surface hardening method comprising the steps of rotating a nearly cylindrical pressurizing tool at a high speed and pressing the bottom surface thereof slightly into the surface of an object to be hardened with a specific pressure so as to generate local frictional heat between the pressurizing tool and the object to be hardened, causing transform to a fine martensitic structure in the portion of the object that receives the frictional heat, and moving the pressurizing tool at a specific speed when the surface of the object in the vicinity of the pressurizing tool starts to soften because of the frictional heat, wherein the frictional heat provides an input heat quantity amounting to the melting temperature of the object to be hardened×0.5 (Kelvin) or larger and the object has a surface temperature of 850 to 1,050° C.

The second aspect of the present invention provides a transformable metal surface hardening method comprising the steps of rotating a nearly cylindrical pressurizing tool at a high speed and pressing the bottom surface thereof slightly into the surface of an object to be hardened with a specific pressure so as to generate local frictional heat between the pressurizing tool and the object to be hardened and stir the surface of the hardening object, causing transformation to a fine martensitic structure and plastic flow in the portion of the object to be hardened that receives the frictional heat, and moving the pressurizing tool at a specific speed when the surface of the object in the vicinity of the pressurizing tool starts to soften because of the frictional heat, wherein the frictional heat provides an input heat quantity amounting to the melting temperature of the object to be hardened×0.5 (Kelvin) or larger and the object has a surface temperature of 850 to 1,050° C.

The third aspect of the present invention provides the surface hardening method according to the above first or second aspect characterized in that the hardness of the object to be hardened after the surface hardening treatment can be adjusted by controlling the input heat quantity Q (W) from the frictional heat based on $Q=4/3\pi^2 \mu PNR^3/V$ (here, $\mu$ is coefficient of friction, P is pressure applied by the pressurizing tool, N is rotation speed of the pressurizing tool, R is diameter of the pressurizing tool, and V is moving speed of the pressurizing tool).

The fourth aspect of the present invention provides the surface hardening method according to the above first or second aspect characterized in that the hardness of the object to be hardened after the surface hardening treatment can be adjusted by controlling the input heat quantity from the frictional heat based on P=N/V (here, P is rotation pitch of the pressurizing tool, N is rotation speed of the pressurizing tool, and V is moving speed of the pressurizing tool).

The fifth aspect of the present invention provides the surface hardening method according to the above third aspect characterized in that the hardness of the object to be hardened after the surface hardening treatment is 500 to 930 Hv provided that the pressure applied by the pressurizing tool is 1,000 to 6,000 Kg and preferably 2,000 to 5,500 Kg, the rotation speed of the pressurizing tool is 400 to 1,500 rpm and preferably 800 to 1,000 rpm, and the diameter of the pressurizing tool is 25 mm, and the moving speed of the pressurizing tool is 40 to 500 mm/min and preferably 50 to 100 mm/min.

The sixth aspect of the present invention provides the surface hardening method according to the above fifth aspect characterized in that the pressure applied by the pressurizing tool is gradually increased in the course of surface hardening treatment.

The seventh aspect of the present invention provides the surface hardening method according to the above first or second aspect characterized in that the pressurizing tool has a bulged bottom surface.

The eighth aspect of the present invention provides the surface hardening method according to the above first or second aspect characterized in that the pressurizing tool has a recessed bottom surface.

The ninth aspect of the present invention provides the surface hardening method according to the above first or second aspect characterized in that the pressurizing tool is made of a metal of high melting point or ceramic having a hardness higher than that of the object to be hardened.

The tenth aspect of the present invention provides the surface hardening method according to the above ninth aspect characterized in that the metal of high melting point used for the pressurizing tool is one selected from the group consisting of tool steel, tungsten alloy, molybdenum alloy, iridium alloy, and tungsten carbide.

The eleventh aspect of the present invention provides the surface hardening method according to the above ninth aspect characterized in that the ceramic used for the pressurizing tool is PCBN (polycrystalline cubic boron nitride) or silicon nitride.

The twelfth aspect of the present invention provides the surface hardening method according to the above first or second aspect characterized in that the pressurizing tool is oriented in relation to the hardening object in the manner that the angle $\theta$ between the bottom surface of the pressurizing tool and the object surface is 0°, namely these surfaces are parallel, during the surface hardening treatment.

The thirteenth aspect of the present invention provides the surface hardening method according to the above first or second aspect characterized in that the pressurizing tool is tilted with the bottom surface raised in the front in the moving direction in the manner that the angle $\theta$ between the bottom surface of the pressurizing tool and the surface of the object to be hardened is in a range from 0.5° to 10° and preferably in a range from 2° to 5° during the surface hardening treatment.

The fourteenth aspect of the present invention provides the surface hardening method according to the above first or second aspect characterized in that the object to be hardened has a base material including 30% or more of a perlite structure.

The fifteenth aspect of the present invention provides the surface hardening method according to the above second aspect characterized in that the hardness of the object to be hardened after the surface hardening treatment is relatively low in the surface portion that is subject to stirring and increased in the portion below the surface portion The sixteenth aspect of the present invention provides the surface hardening method according to the above fifteenth characterized in that the surface portion having a relatively low hardness is scraped off by machining.

Technical Advantages Obtained from the Invention

The present invention having the above aspects has the flowing effects and advantages.

The surface hardening method of the present invention allows for efficient hardening treatment in a simple and quick manner regardless of the shape of the object.

The surface hardening method of the present invention utilizes heating by frictional heat under pressure instead of external, compulsive heating. Therefore, an object to be hardened is not overheated, preventing volume loss (melt loss). Recrystallization of the object to be hardened is accelerated and neither larger crystal grains nor brittle hardened layer is formed.

In the surface hardening method of the present invention, the effect of frictional heat on the object to be hardened is limited to its small area. Therefore, little internal stress occurs and then the object to be hardened is subject to no quenching crack, distortion, or deformation.

The surface hardening method of the present invention is carried out based on assured controls easily leading to optimum input heat quantity conditions for the object to be hardened such as controlling of the pressure force applied by the pressurizing tool, controlling of the rotation pitch or rotation speed and moving speed of the pressurizing tool, and controlling of the orientation of the pressurizing tool in relation to the object to be hardened whereby an entirely uniform hardness can be obtained with no soft spot under the same conditions.

Furthermore, in the surface hardening method of the present invention, the effect of heat on the object to be hardened is limited to a very small area and the heated part continuously shifts, whereby the object cools off quickly. Therefore, neither thermal stress due to temperature difference nor transformation stress occurs and the object to be hardened object is subject to no deformation or distortion.

The above and other purposes, aspects, and advantages of the present invention will be apparent to skilled persons in the field through the following detailed explanation and attached drawings that exemplify preferable embodiments complying with the principle of the present invention.

BRIEF EXPLANATION OF THE DRAWINGS

FIG. 18 is a table showing the Rockwell hardness of various objects to be hardened after the surface hardening treatment according to the first to the sixth embodiments of the present invention.

LEGEND

1 object to be hardened
2 pressurizing tool
3 pressurizing/rotating/moving apparatus

BEST MODES FOR IMPLEMENTING THE INVENTION

Best modes for realizing the present invention will be described hereafter with reference to the accompanying drawings.

As described above, the surface hardening method of the present invention is a transformable metal surface hardening method in which transformation and fine structure are achieved simultaneously on an object to be hardened using frictional heat. Therefore, materials such as steel, cast iron, and titanium can be a target of an object to be hardened as a base material. As for the composition, the base material suitable for the surface hardening method of the present invention contains 30% or more of a perlite structure.

Figure 1:
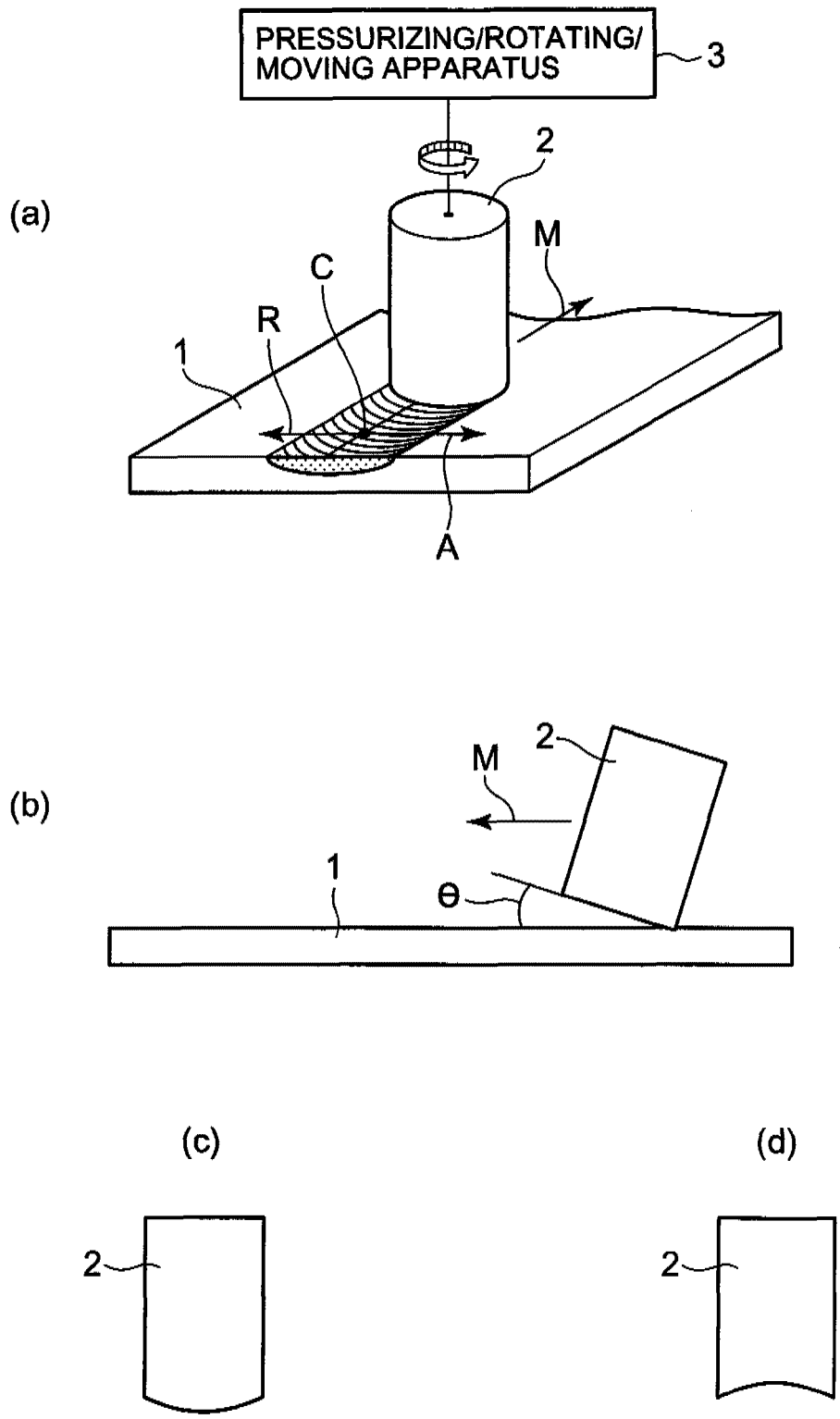
FIG. 1 (*a*) is a schematic perspective view showing an apparatus for realizing the surface hardening method of the present invention and the way of operating it, FIG. 1 (*b*) is a schematic side view showing a position of the pressurizing tool in realizing the surface hardening method of the present invention and FIGS. 1 (*c*) and (*d*) are side views showing the shape of the pressurizing tool.

FIG. 1 (*a*) is a schematic perspective view of an apparatus for realizing the transformable metal surface hardening method of the present invention.

Referring to FIG. 1 (*a*), reference numeral 1 shows an object 1 to be hardened comprising a transformable metal, 2 shows a nearly cylindrical pressurizing tool that applies pressure, rotates, and moves by means of a pressurizing/rotating/moving apparatus 3 used for NC (numerical control) machining tools not specifically shown.

Although the pressurizing tool 2 may vary depending upon the material of the object 1 to be hardened, the pressurizing tool 2 is slightly pressed into the surface of the object 1 empirically with a pressure approximately in a range from 2,000 to 6,000 Kg during the surface hardening treatment. Then, the pressurizing tool 2 is rotated in the wide-arrowed direction at a rotation speed in a range from 400 to 1,500 rpm while it is moved in the arrowed direction M at a speed in a range from 40 to 500 mm/min and preferably at a speed in a range from 40 to 200 mm/min. However, it is needless to say that the above ranges are not restrictive.

The length of the surface hardening treatment on the object 1 to be hardened is adjusted by the moving distance of the pressurizing tool 2. On the other hand, the width of the surface hardening treatment is adjusted by the selection of the diameter of the pressuring tool 2 and the number of treatment operations. In other words, the adjoining friction and stirring process can be repeated when a larger width of the surface hardening treatment is desired on the object 1 to be hardened 1.

The high speed rotation of the pressurizing tool 2 under pressure generates frictional heat between the object 1 to be hardened and the pressurizing tool 2 and the part of the object 1 that receives the frictional heat transforms. In the present invention, this transformation causes a fine martensitic structure crystal to be created. The fine crystal strengthens and hardens the material.

In the present invention, another factors for crystal after transformed to become fine martensitic structure crystal are pressurizing under a high pressure and/or occurrence of plastic flow of the object 1 due to stirring. Furthermore, the pressurizing tool which contributes to generation of the frictional heat is moved and therefore the heat generation is localized on the object to be hardened. Then, such quick cooling gives the crystal no time to grow.

It is known that the heat quantity Q (W) provided by the frictional heat input in the object 1 to be hardened is expressed by $Q=4/3\pi^2\ \mu pNR^3/V$ (here, $\mu$ is a friction coefficient, P is pressure applied by the pressurizing tool, N is rotation speed of the pressurizing tool, R is a diameter of the pressurizing tool, and V is a moving speed of the pressurizing tool). According to this equation, the heating value Q of the frictional heat and stirring is proportional to pressure P applied by the pressurizing tool 2, rotation speed N of the pressurizing tool 2, and the third power of the diameter R of the pressurizing tool 2 but is inversely proportional to moving speed V of the pressurizing tool 2. From the other aspect, input heat quantity Q (W) can simply be expressed by p=V/N (here, p is rotation pitch of the pressurizing tool, V is moving speed of the pressurizing tool 2, and N is rotation speed of the pressurizing tool). In this equation, the moving distance of the pressurizing tool 2 per rotation (rotation pitch) is an indicator. In other words, as the rotation pitch is increased, the input heat quantity is decreased.

In the present invention, the heating of the object 1 to be hardened is controlled based on the above equations. In other words, the heating temperature of the object 1 can be adjusted by properly controlling the rotation pitch of the pressurizing tool 2 or the rotation speed and moving speed of the pressurizing tool 2. Consequently, the present invention can realize the surface hardening treatment based on assured controls easily leading to optimum conditions for the object 1 to be hardened.

The input heat quantity from frictional heat in the present invention amounts to the melting temperature (Kelvin) of the object 1×0.5 or larger. In such a case, the object has a surface temperature in a range from 850 to 1050° C.

Furthermore, in the present invention, the orientation of the pressurizing tool 2 in relation to the object 1 during the surface hardening treatment, in other words the angle between the bottom surface of the pressurizing tool 2 and the surface of the object 1 greatly affects the pressurizing and stirring on the object 1. The angle made by these two surfaces is basically 0°; namely, the bottom surface of the pressurizing tool 2 and the surface of the object 1 are parallel. However, the pressurizing tool 2 can be tilted with the bottom surface raised in the front in the moving direction of the pressurizing tool 2 (the arrowed direction M) so that the angle θ between the two surfaces is in a range from 0.5° to 10° and preferably in a range from 2° to 5° (see FIG. 1 (*b*)), depending upon the materials of the object to be hardened and the rotation pitch of the pressurizing tool 2.

The shape of the pressurizing tool 2 used in the surface hardening treatment of the present invention will be described hereafter.

The nearly cylindrical pressurizing tool in the embodiments described later has a diameter of 25 mm. The pressurizing tool having a diameter in a range from 15 to 50 mm was tested in experiments leading to the present invention. When the pressurizing tool 2 has a diameter smaller than 15 mm, there will be such problem that the pressurizing tool 2 is pressed into the object 1 deeper than necessary because of the softened surface thereof during the treatment. It has been noted that the pressurizing tool 2 was pressed into the object 1 deeper than necessary because a load-fixed control apparatus was used in the embodiments described later. This problem can be obviated by controlling the pressuring tool 2 in relation to the object 1 in a position-fixed manner. In such a case, the pressuring tool 2 having a diameter smaller than 15 mm can better be used. With the pressurizing tool 2 of a diameter larger than 50 mm, an excessively large load is required to apply a sufficient pressure for creating a fine martensitic structure. However, it is needless to say that the pressurizing tool 2 having a diameter larger than 50 mm can be allowed by using an extremely highly rigid, large apparatus.

As the object 1 softened during the surface hardening treatment tends to deposit on the periphery of the pressurizing tool 2, then, as shown in FIG. 1 (*c*) and (*d*), it is preferable that the bottom surface is bulged or, conversely, recessed. The pressurizing tool of the present invention basically has a planar bottom surface. However, a probe (a pin-like projection) can be provided on the bottom surface at the center axis position or at an eccentric point depending on the material of the object 1 in order to accelerate and deepen the stirring.

The pressurizing tool 2 can be made of a high melting point metal or ceramics having a hardness higher than the object 1 to be hardened. The high melting point metal can be any one selected from the group consisting of tool steel, tungsten alloy, molybdenum alloy, iridium alloy, and tungsten carbide (sintered hard alloy). The ceramics may be PCBN (polycrystalline cubic boron nitride) or silicon nitride (Si3N4).

Several preferable embodiments of the surface hardening method of the present invention using the above apparatus will be described hereafter with reference to the accompanying drawings. In the following description, a center of the pressurized and stirred portion of the object 1 to be hardened in the width direction (where the center of a diameter of the pressurizing tool 2 is positioned) is defined as a center C. One side of the pressurized and stirred portion on the object 1 which flows from the point C as a basic point in the same direction as the moving direction M of the pressurizing tool 2 is defined as an advancing side and the other side of the pressurized and stirred portion on the object 1 which flows from the point C as a basic point in the direction opposite to the moving direction M of the pressurizing tool 2 is defined as a retreating side. Referring to FIG. 1 (*a*), the arrow "A" represents the advancing side and the arrow "R" represents the retreating side.

FIRST EMBODIMENT

Figure 2:
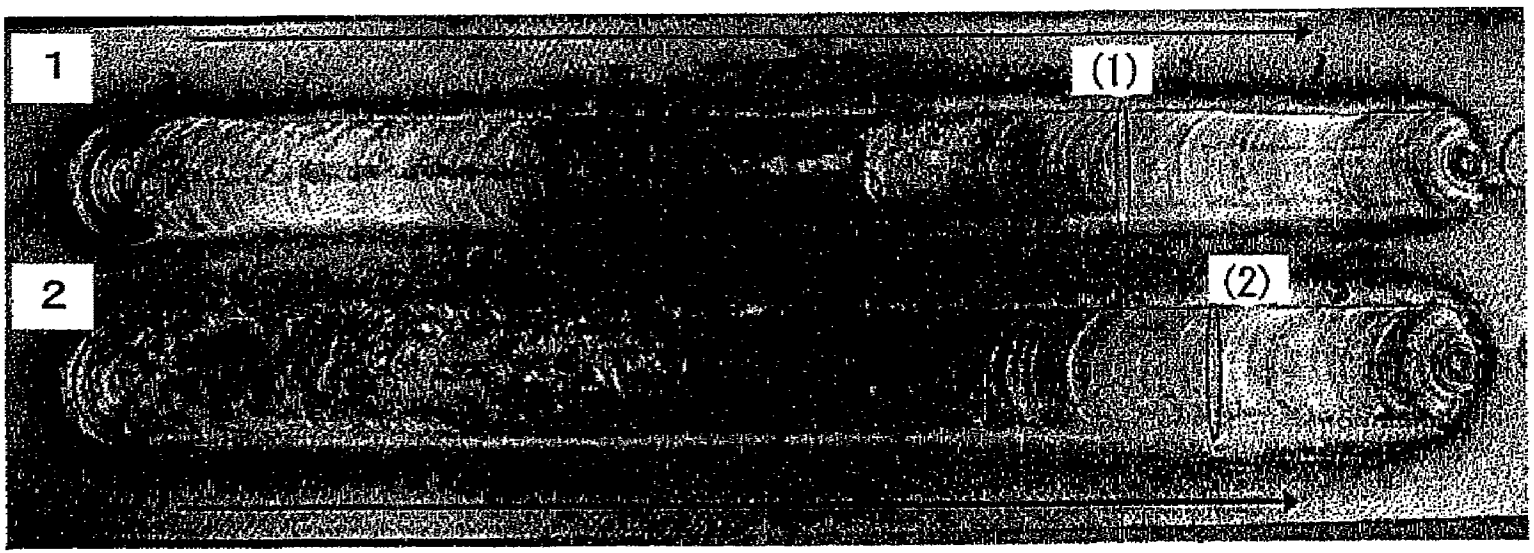
FIG. 2 is a photograph showing the surface state of an object to be hardened after the hardening treatment according to the first and the second embodiments of the present invention seen from above.
Figure 3:
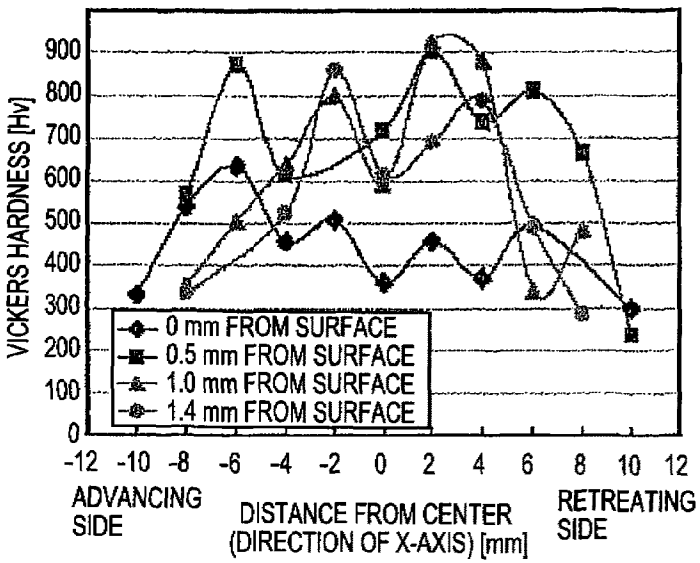
FIG. 3 (*a*) is a table showing the hardness at specific points of an object to be hardened after the hardening treatment according to the first embodiment of the present invention, FIG. 3 (*b*) is a graphical representation showing the hardness at points advanced and retreated from the center based on the table of FIG. 3 (*a*) and FIG. 3 (*c*) is a graphical representation showing the hardness at different depths from the surface based on the table of FIG. 3 (*a*).
Figure 3:
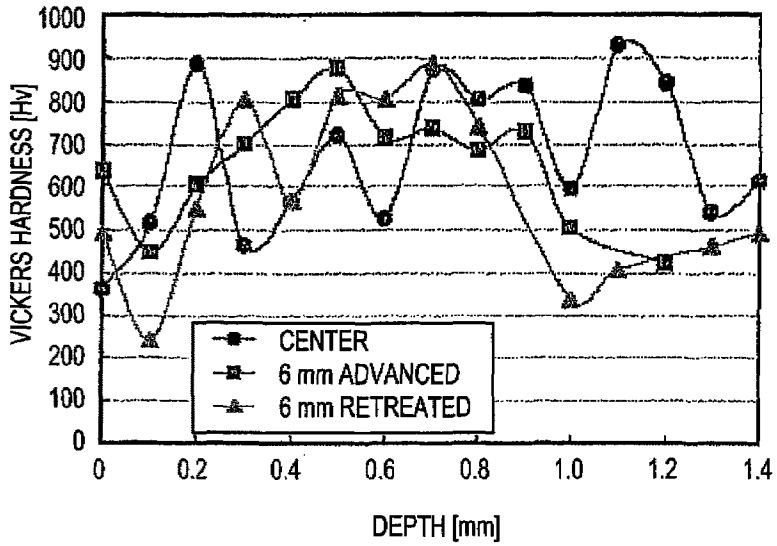
Figure 4A:
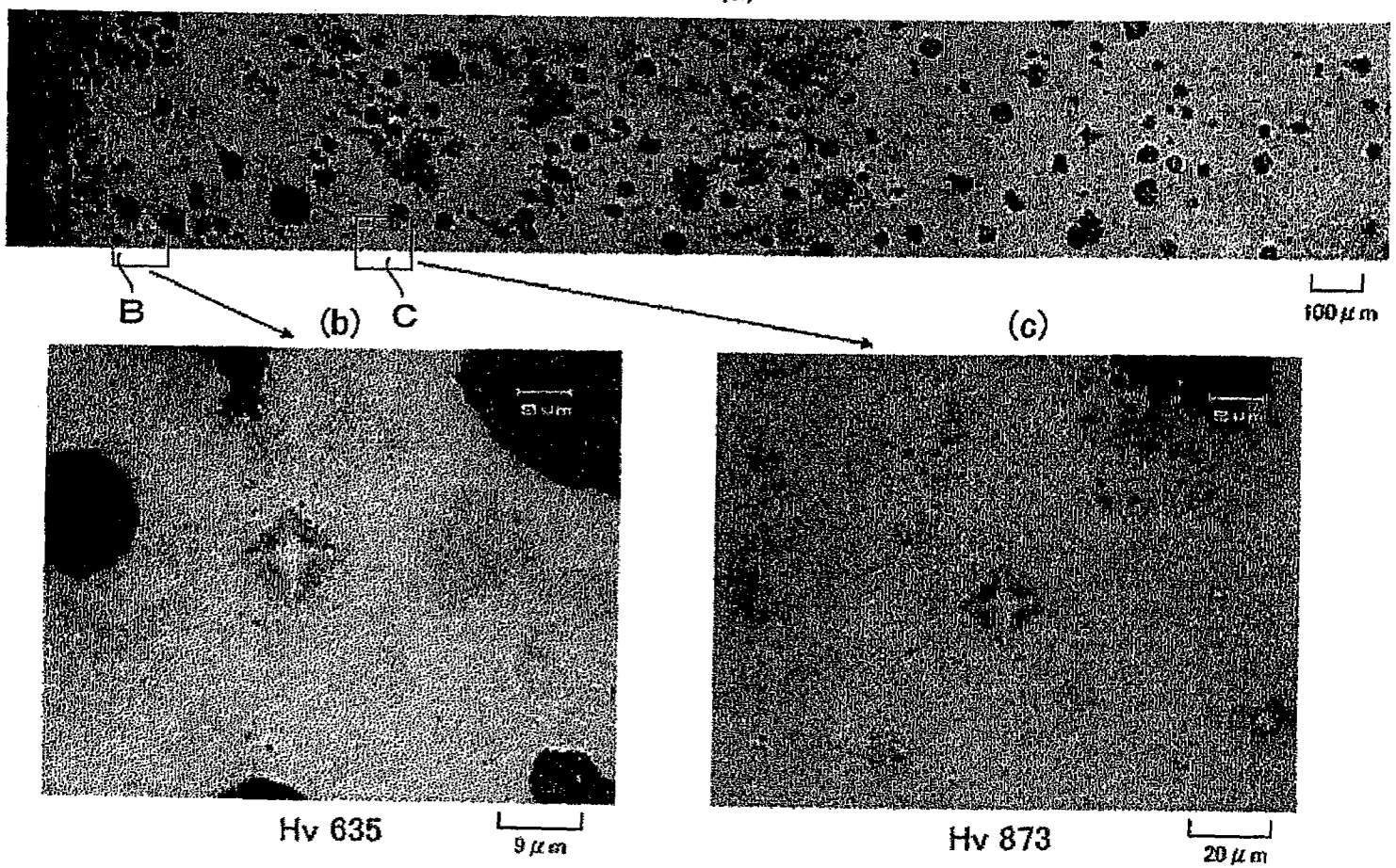
FIG. 4A (*a*) is a microphotograph showing the structure of a hardening object after the hardening treatment according to Embodiment 1 of the present invention in a vertical cross-section at a 6-mm advanced point from the center of a stirred portion, FIG. 4A (*b*) is an enlarged microphotograph of the structure at a point B in FIG. 4A and FIG. 4A (*c*) is an enlarged microphotograph of the structure at a point C in FIG. 4A.
Figure 4B:
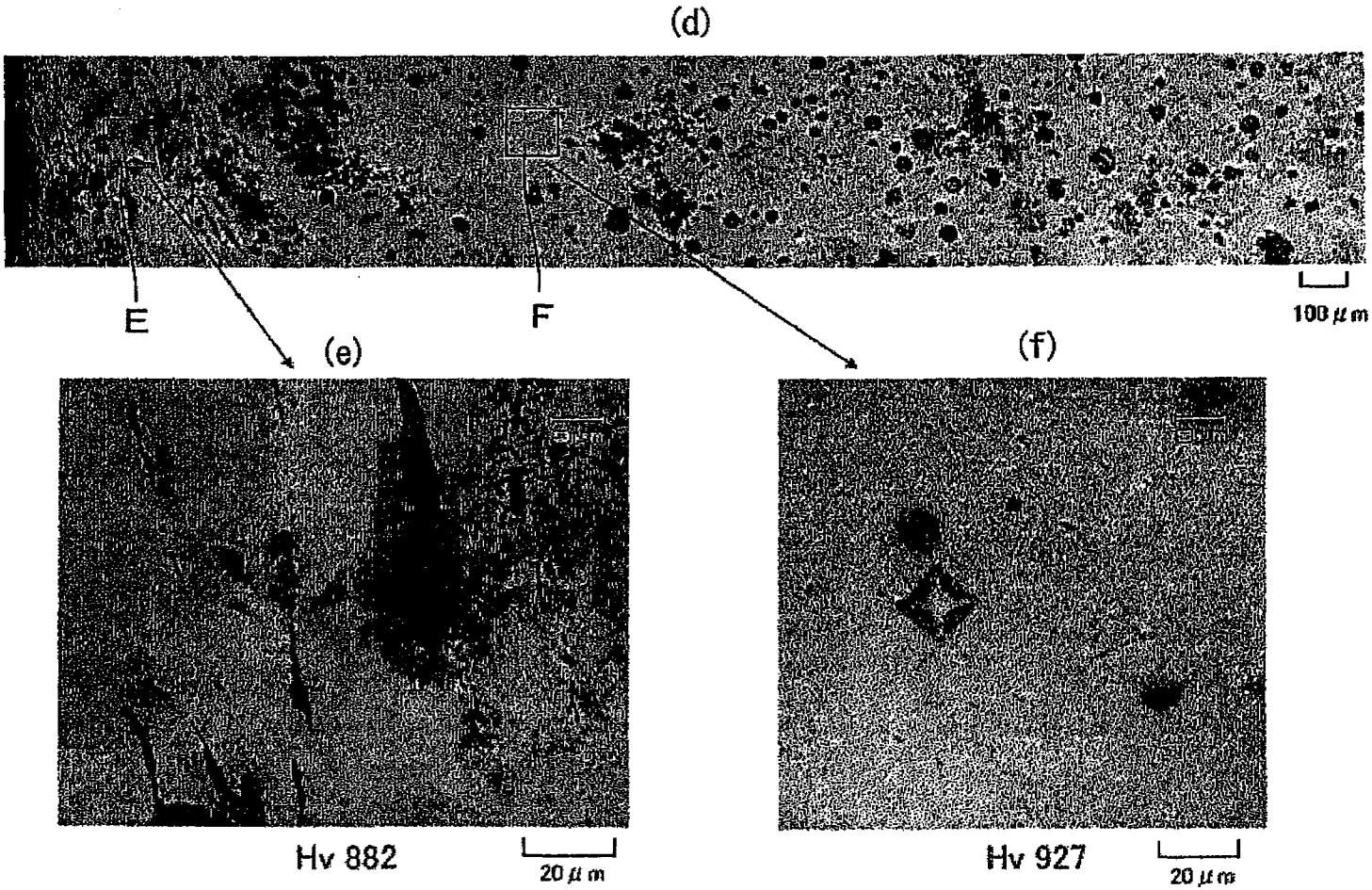
FIG. 4B (*d*) is a microphotograph showing the structure of an object to be hardened after the hardening treatment according to the first embodiment of the present invention in a vertical cross-section at the center of a stirred portion, FIG. 4B (*e*) is an enlarged microphotograph of the structure at a point E in FIG. 4B and FIG. 4B (*f*) is an enlarged microphotograph of the structure at a point F in FIG. 4B.

The results of the surface hardening treatment of a nodular graphite cast iron (FCD700) as the object 1 to be hardened according to the first embodiment using the apparatus shown in FIG. 1 (*a*) are shown in No. 2 of FIG. 2 showing the surface state of the object 1 after the hardening treatment, FIG. 3 (*a*) to (*c*) showing the hardness (Hv) of the object 1 after the hardening treatment, and FIG. 4A (*a*) to (*c*) and FIG. 4B (*d*) to (*f*) that are microphotographs each showing the micro structure of the object 1 after the hardening treatment. Here, the base material of the object 1 had a hardness of 202 to 234 Hv.

The pressurizing was implemented with the pressurizing tool 2 under the following conditions.

Diameter: 25 mm (no probe)
Material: tungsten carbide
Pressure: 2,000 to 3,600 Kg
Rotation speed: 800 to 1,000 rpm
Moving speed: 50 mm/min The initial pressure and rotation speed were 2,000 Kg and 1,000 rpm, respectively. The pressure was gradually increased while the rotation speed was gradually reduced. The pressure and rotation speed were 3,600 Kg and 800 rpm, respectively, in the vicinity of the cross-section at the position (2) in FIG. 2.

The hardness (Hv) of the object after being subject to the hardening treatment in the vicinity of a cross-section (2) in FIG. 2 is shown in FIG. 3 (*a*) to (*c*). Specifically, the hardness varies between the lowest value of 226.6 Hv at a point 10 mm retreated in the cross-section (2) and 0.8 mm deep from the surface and the highest value of 927 Hv at a point at the center of the cross-section (2) and 1.1 mm deep from the surface and at a point 2 mm retreated in the cross-section (2) and 1.0 mm deep from the surface.

Even under such variance of the hardness, the object 1 has a hardness of 600 to 930 Hv except for the surface portion (0 to 0.2 mm) and the vicinity of the center of the pressurizing tool 2. Thus the effect of modification has been recognized.

SECOND EMBODIMENT

Figure 5:
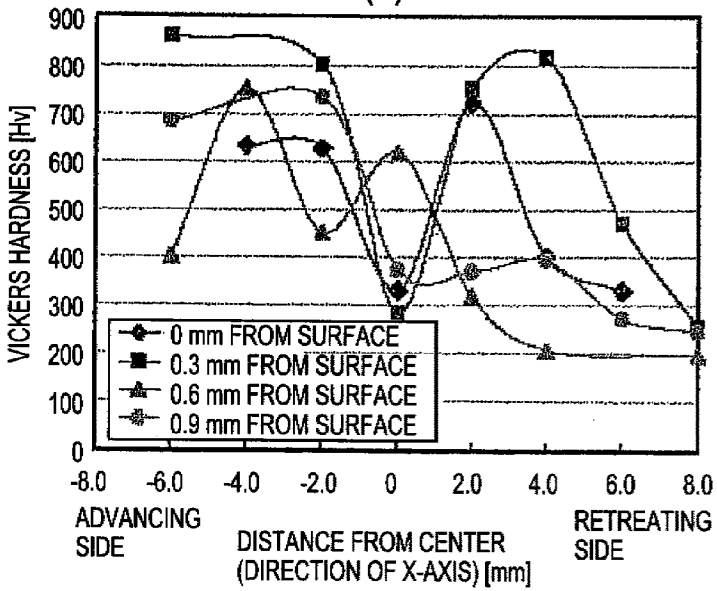
FIG. 5 (*a*) is a table showing the hardness at specific points of an object to be hardened after the hardening treatment according to the second embodiment of the present invention, FIG. 5 (*b*) is a graphical representation showing the hardness at different points from the center based on the table of FIG. 5 (*a*) and FIG. 5 (*c*) is a graphical representation showing the hardness at different depths from the surface based on the table of FIG. 5 (*a*).
Figure 5:
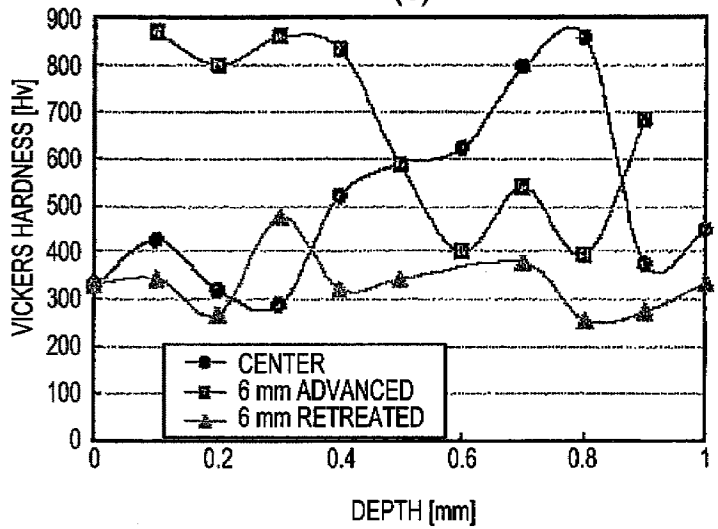
Figure 6A:
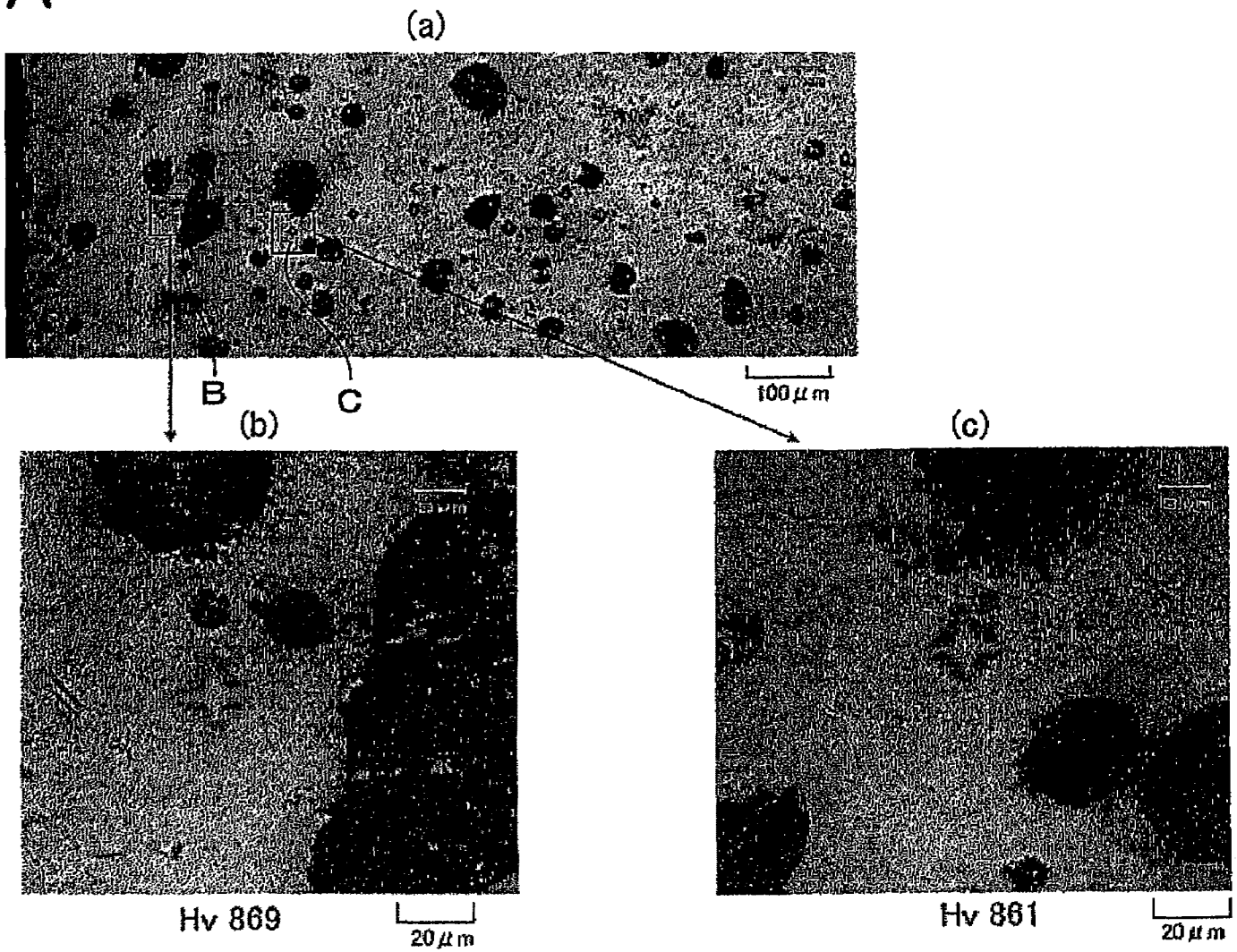
FIG. 6A (*a*) is a microphotograph showing the structure of an object to be hardened after the hardening treatment according to the second embodiment of the present invention in a vertical cross-section at a 6-mm advanced point from the center of a stirred portion, FIG. 6A (*b*) is an enlarged microphotograph of the structure at a point B in FIG. 6A and FIG. 6A (*c*) is an enlarged microphotograph of the structure at a point C in FIG. 6A.
Figure 6B:
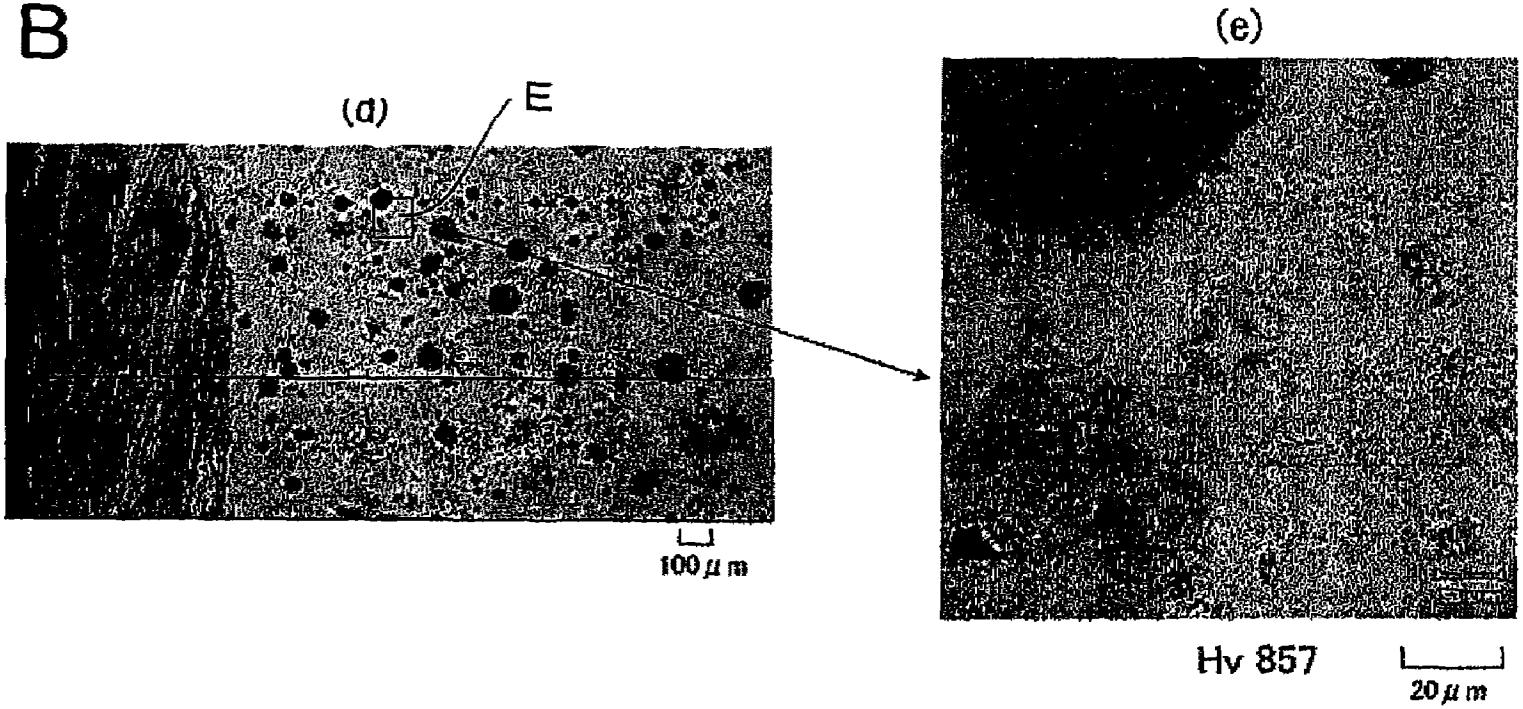
FIG. 6B (*d*) is a microphotograph showing the structure of an object to be hardened after the hardening treatment according to the second embodiment of the present invention in a vertical cross-section at the center of a stirred portion and FIG. 6B (*e*) is an enlarged microphotograph of the structure at a point E in FIG. 6B(*d*).

The results of the surface hardening treatment of a nodular graphite cast iron (FCD700) as an object to be hardened according to the second embodiment using the apparatus shown in FIG. 1 (*a*) are shown as in the same manner as the first embodiment in 1 of FIG. 2 showing the surface state of the object after being subject to the hardening treatment, FIG. 5 (*a*) to (*c*) showing the hardness (Hv) of the object after being subject to the hardening treatment, and FIG. 6A (*a*) to (*c*) and FIGS. 6B (*d*) and (*e*) that are microphotographs each showing the micro structure of the object after the hardening treatment. Here, the base material of the object to be hardened has a hardness of 202 to 234 Hv.

The pressurizing was implemented with the pressurizing tool 2 under the following conditions in the second embodiment.

Diameter: 25 mm (no probe)
Material: tungsten carbide
Pressure: 2,000 to 3,000 Kg
Rotation speed: 900 rpm
Moving speed: 100 mm/min The initial pressure and rotation speed were 2,000 Kg and 900 rpm, respectively. The pressure was gradually increased. The pressure and rotation speed were 3,000 Kg and 900 rpm, respectively, in the vicinity of a cross-section (1) in FIG. 2.

The hardness (Hv) of the object after being subject to the hardening treatment in the vicinity of a cross-section (1) in FIG. 2 is shown in FIG. 5 (*a*) to (*c*). Specifically the hardness varies between the lowest value of 205.3 Hv at a point 4 mm retreated in the cross-section (1) and 0.6 mm deep from the surface and the highest value of 908.7 Hv at a point 2 mm advanced in the cross-section (1) and 0.1 mm deep from the surface.

The pressure applied by the pressurizing tool 2 was set to be lower in the second embodiment than in the first embodiment. Furthermore, the rotation speed was reduced and the moving speed was doubled to increase the rotation pitch while the input heat quantity by friction and stirring was also set to be lower. Consequently, the overall hardness profile was lower than that of the first embodiment. Even under such conditions, the object 1 had a hardness of 500 to 900 Hv except for the surface portion (0 to 0.2 mm) and the vicinity of the center of the pressurizing tool 2. Thus the effect of modification has been recognized.

THIRD EMBODIMENT FOR COMPARATIVE PURPOSE

In this embodiment, the pressurizing tool 2 having a probe of 1.5 mm in length on the bottom surface was used in the hardening treatment of the same nodular graphite cast iron (FCD700) as in the first and the second embodiments.

Figure 7:
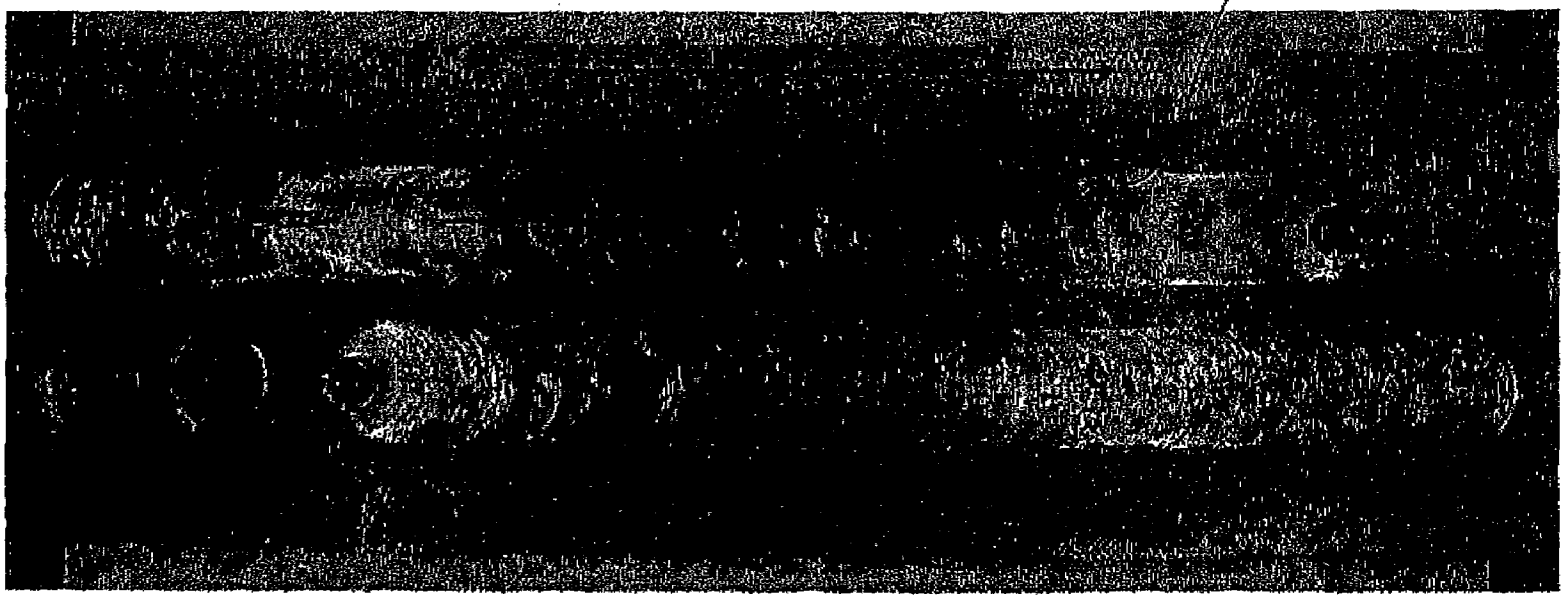
FIG. 7 is a photograph showing the surface of an object to be hardened after the hardening treatment according to the third embodiment of the present invention seen from above.
Figure 8:
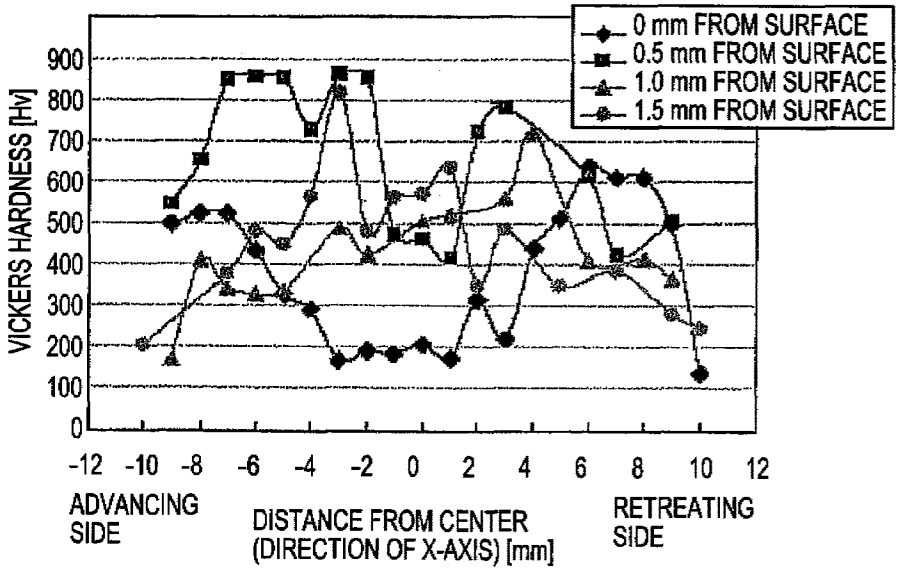
FIG. 8 (*a*) is a table showing the hardness at specific points of an object to be hardened after the hardening treatment according to the third embodiment of the present invention, FIG. 8 (*b*) is a graphical representation showing the hardness at different points from the center based on the table of FIG. 8 (*a*), and FIG. 8 (*c*) is a graphical representation showing the hardness at different depths from the surface based on the table of FIG. 8 (*a*).
Figure 8:
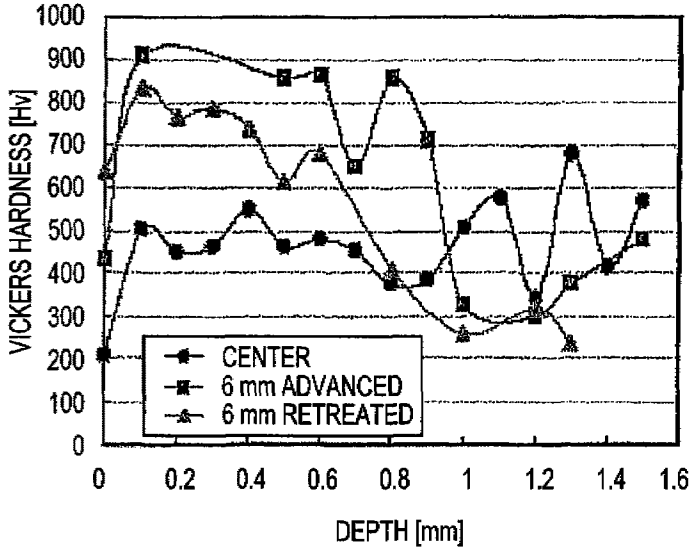
Figure 9A:
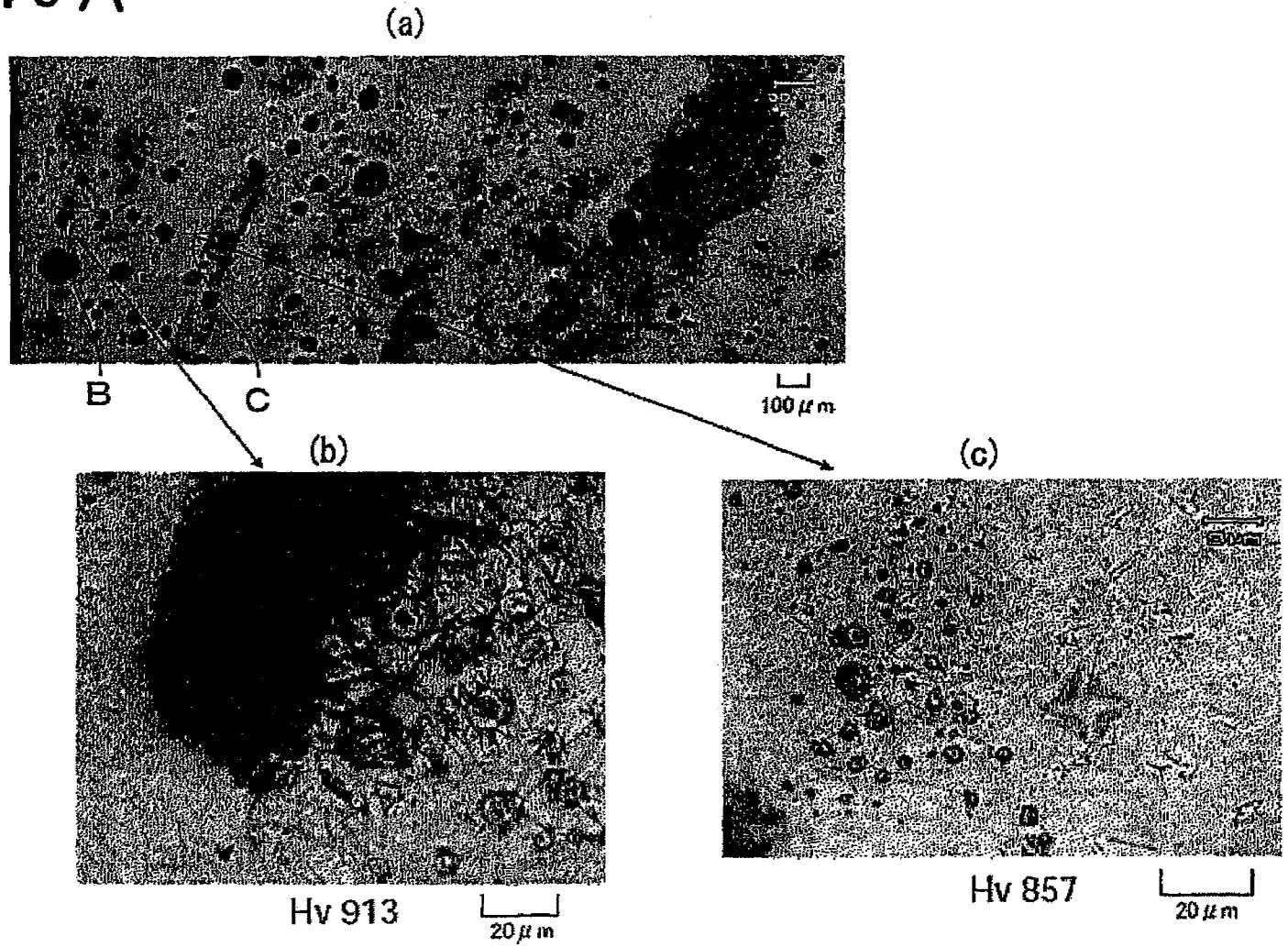
FIG. 9A (*a*) is a microphotograph showing the structure of an object to be hardened after the hardening treatment according to the third embodiment of the present invention in a vertical cross-section at a 6-mm advanced point from the center of a stirred portion, FIG. 9A (*b*) is an enlarged microphotograph of the structure at a point B in FIG. 9A (*a*) and FIG. 9A (*c*) is an enlarged microphotograph of the structure at a point C in FIG. 9A (*a*).
Figure 9B:
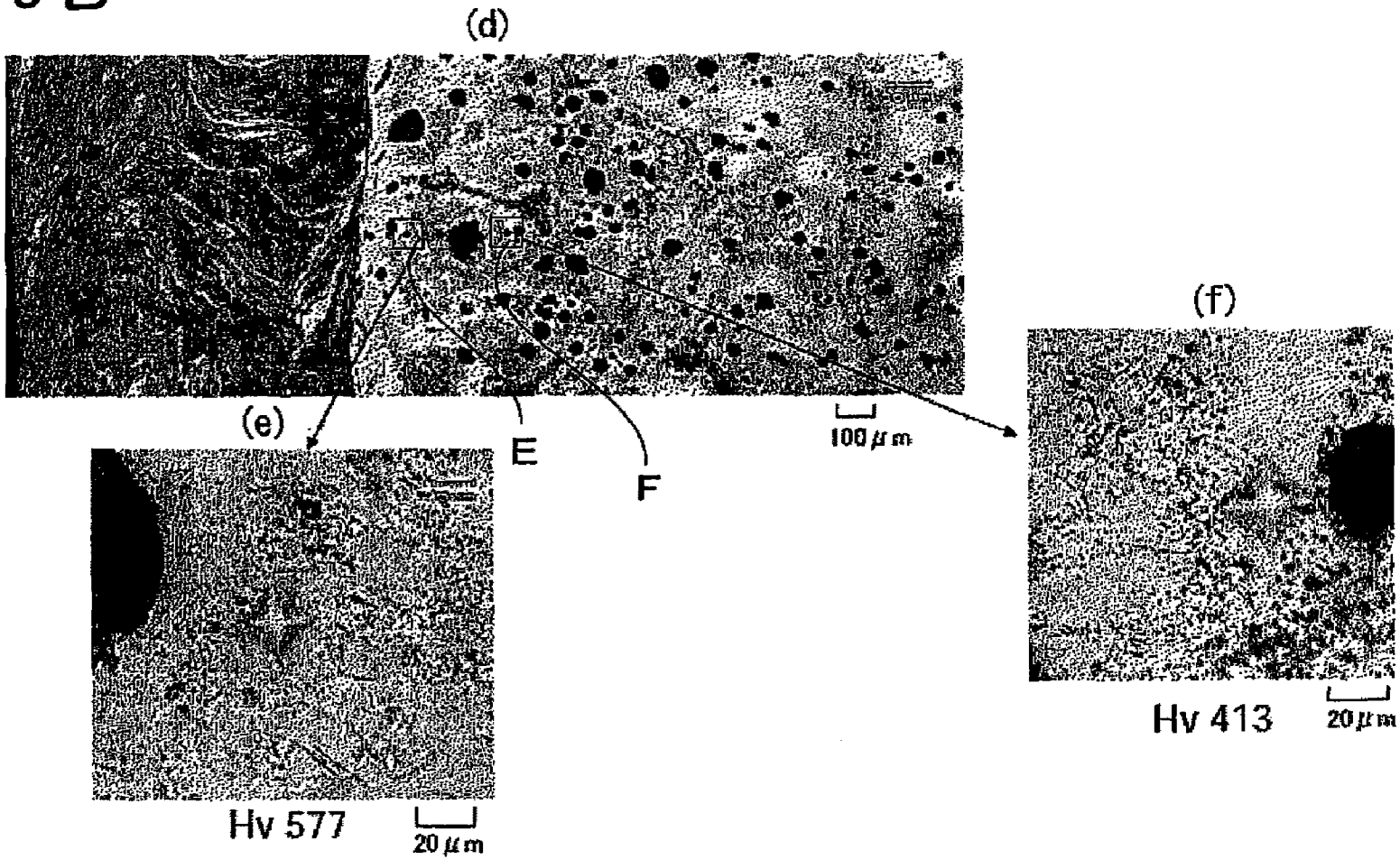
FIG. 9B (*d*) is a microphotograph showing the structure of an object to be hardened after the hardening treatment according to the third embodiment of the present invention in a vertical cross-section at the center of a stirred portion, FIG. 9B (*e*) is an enlarged microphotograph of the structure at a point E in FIG. 9B (*d*) and FIG. 9B (*f*) is an enlarged microphotograph of the structure at a point F in FIG. 9B (*d*).

The results of the surface hardening treatment of the third embodiment are shown in FIG. 7 showing the surface condition of the object after being subject to the hardening treatment, FIG. 8 (*a*) to (*c*) showing the hardness (Hv) of the object after the hardening treatment, and FIG. 9A (*a*) to (*c*) and FIG. 9B (*d*) to (*f*) that are microphotographs each showing the micro structure of the object after being subject to the hardening treatment. Here, the base material of the object to be hardened had a hardness of 202 to 234 Hv.

The pressurizing in the third embodiment was implemented with the pressurizing tool 2 under the following conditions.

Diameter: 25 mm (with a probe of 1.5 mm in length)
Material: tungsten carbide
Pressure: 2,000 to 3,200 Kg
Rotation speed: 900 rpm
Moving speed: 50 mm/min The initial pressure and rotation speed were 2,000 Kg and 900 rpm, respectively. The pressure was gradually increased while the same rotation speed was maintained. The pressure was 3200 Kg in a cross-section (1) in FIG. 7.

The pressurizing tool 2 was provided with a probe to enhance the stirring. Then, the pressure was slightly lowered than in the first embodiment. The pressurizing tool 2 was moved at the same speed as in the first embodiment. Consequently, the hardness (Hv) of the object after being subject to the hardening treatment in the vicinity of a cross-section (1) in FIG. 7 is shown in FIG. 8 (*a*) to (*c*). Hardness thus obtained varied between the lowest value of 136.6 Hv at a point 10 mm retreated in the cross-section (1) and 0.0 mm deep from the surface and the highest value of 913.3 Hv at two points 6 mm and 8 mm advanced in the cross-section (1), respectively, and 0.1 mm deep from the surface. However, the object had a hardness of 400 to 880 Hv except for the surface portion (o to 0.2 mm) and the vicinity of the center of the pressuring tool 2.

The hardness obtained in the third embodiment was analyzed and it was revealed that the hardness of the object 1 after being subject to the hardening treatment was overall lower than that obtained in the first embodiment as apparent from comparison between FIG. 3 (*c*) of the first embodiment and FIG. 8 (*c*) of the third embodiment for comparative purpose. Particularly, the too much stirred portion has lower hardness.

FOURTH EMBODIMENT

Figure 10:
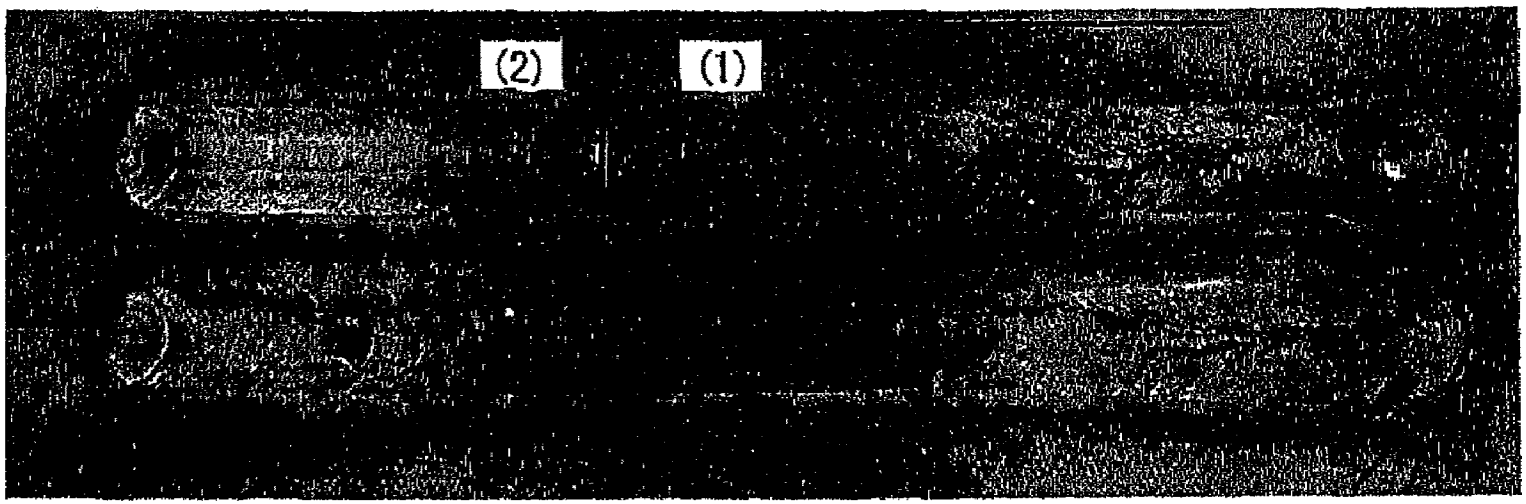
FIG. 10 is a photograph showing the surface of an object to be hardened after the hardening treatment according to the fourth and the fifth embodiments of the present invention seen from above.
Figure 11:
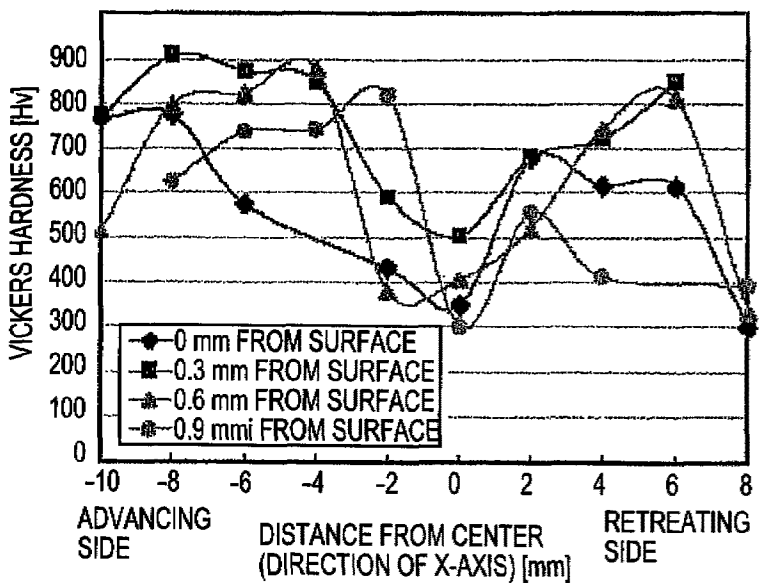
FIG. 11 (*a*) is a table showing the hardness at specific points of an object to be hardened after the hardening treatment according to the fourth embodiment of the present invention, FIG. 11 (*b*) is a graphical representation showing the hardness at different points from the center based on the table of FIG. 11A (*a*) and FIG. 11 (*c*) is a graphical representation showing the hardness at different depths from the surface based on the table of FIG. 11A (*a*).
Figure 11:
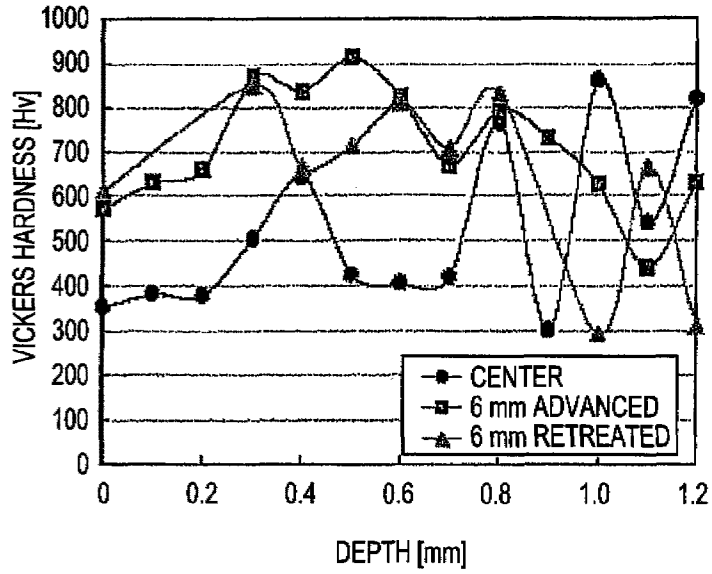
Figure 12A:
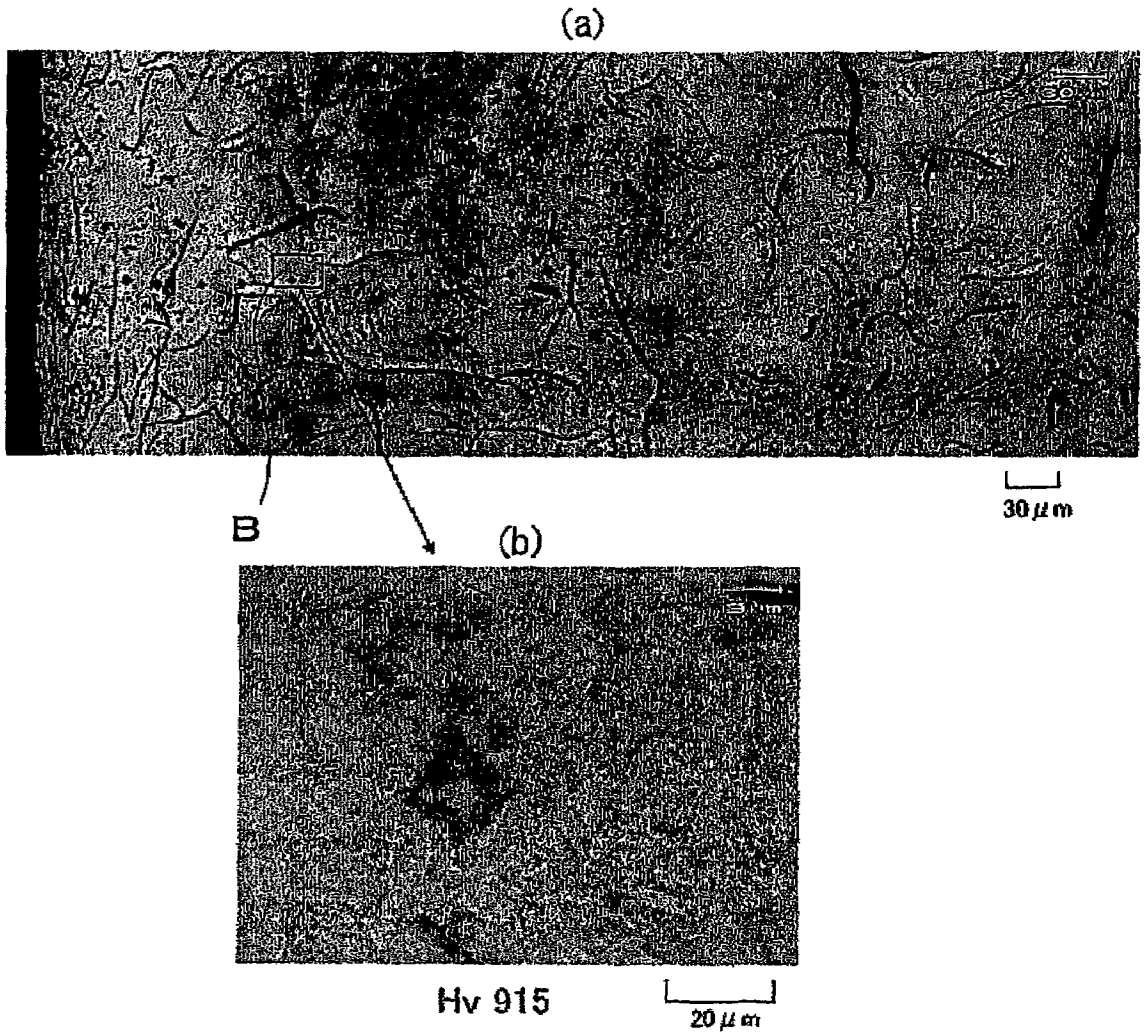
FIG. 12A (*a*) is a microphotograph showing the structure of an object to be hardened after the hardening treatment according to the fourth embodiment of the present invention in a vertical cross-section at a 6-mm advanced point from the center of a stirred portion and FIG. 12A (*b*) is an enlarged microphotograph of the structure at a point B in FIG. 12A (*a*).
Figure 12B:
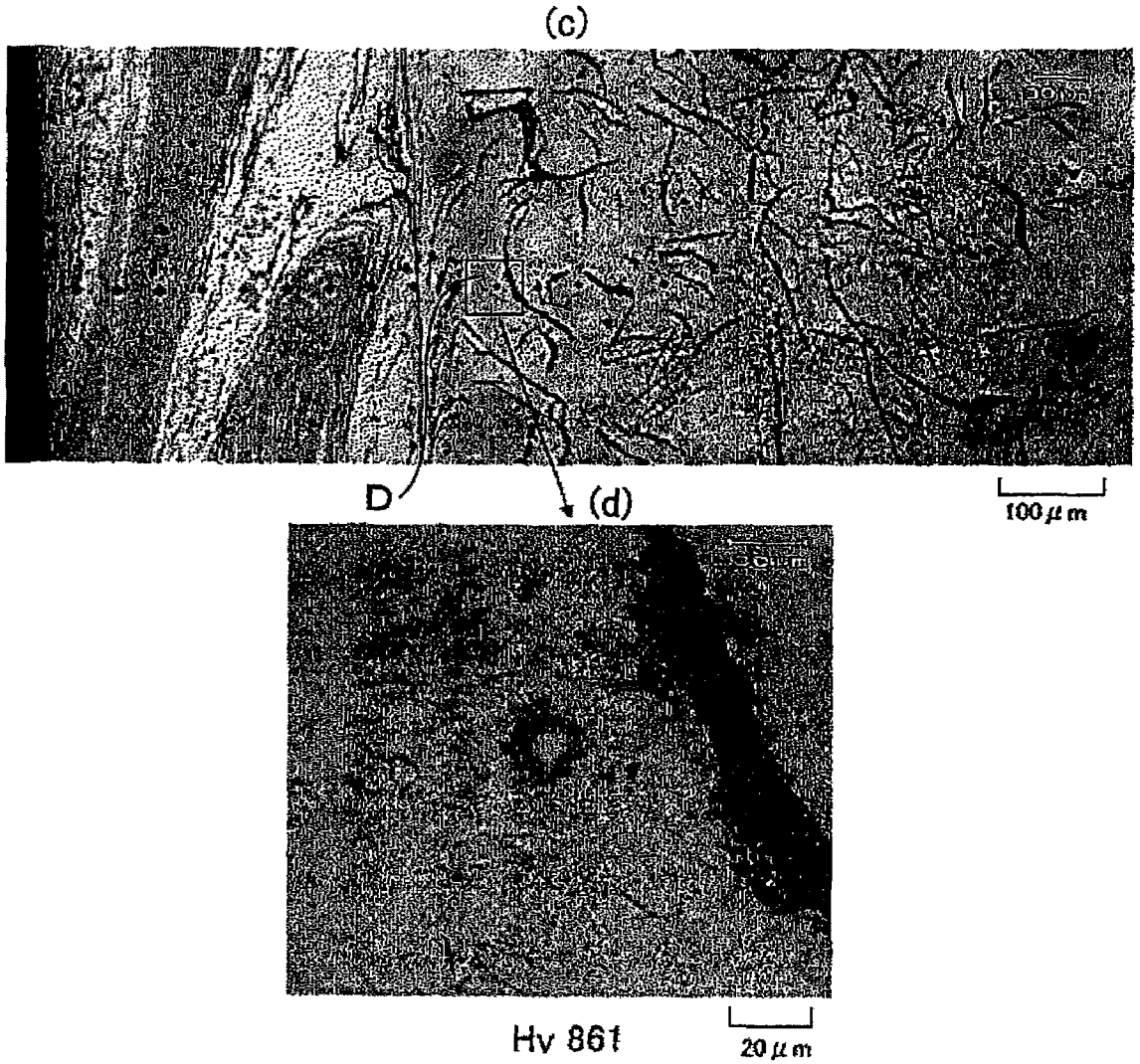
FIG. 12B (*c*) is a microphotograph showing the structure of an object to be hardened after the hardening treatment according to the fourth embodiment of the present invention in a vertical cross-section at the center of a stirred portion and FIG. 12B (*d*) is an enlarged microphotograph of the structure at a point D in FIG. 12B (*c*).

The results of the surface hardening treatment on a flake graphite cast iron (FC300) as an object to be hardened according to the fourth embodiment using the apparatus shown in FIG. 1 (*a*) are shown in FIG. 10 showing the surface condition of the object after being subject to the hardening treatment, FIG. 11 (*a*) to (*c*) showing the hardness (Hv) of the object after being subject to the hardening treatment, and FIGS. 12A (*a*) and (*b*) and FIGS. 12B (*c*) and (*d*) that are microphotographs each showing the micro structure of the object after being subject to the hardening treatment. Here, the base material of the object to be hardened has a hardness of 178 to 212 Hv.

The pressurizing was implemented in the fourth embodiment with the pressurizing tool 2 under the following conditions.

Diameter: 25 mm (no probe)
Material: tungsten carbide
Pressure: 1,000 to 5,500 Kg
Rotation speed: 900 rpm
Moving speed: 50 mm/min The initial pressure and rotation speed were 1,000 Kg and 900 rpm, respectively. The pressure was gradually increased while the same rotation speed was maintained. The pressure was 4,600 Kg in the vicinity of a cross-section (1) in FIG. 10.

The hardness (Hv) of the object after being subject to the hardening treatment in the vicinity of a cross-section (1) in FIG. 10 is shown in FIG. 11 (*a*) to (*c*). The hardness varies between the lowest value of 141.7 Hv at a point 8 mm retreated in the cross-section (1) and 1.1 mm deep from the surface and the highest value of 927.0 Hv at a point 4 mm advanced in the cross-section (1) and 0.4 mm deep from the surface.

Even under such variance of the hardness, the object 1 has a hardness of 600 to 900 Hv except for the surface portion (0 to 0.2 mm) and the vicinity of the center of the pressurizing tool 2. Thud the effect of modification has been recognized.

FIFTH EMBODIMENT

Figure 13:
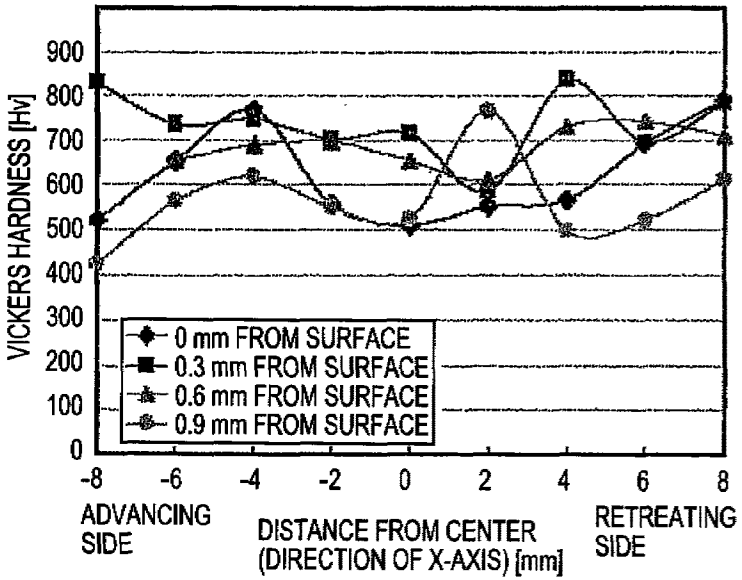
FIG. 13 (*a*) is a table showing the hardness at specific points of an object to be hardened after the hardening treatment according to the fifth embodiment of the present invention, FIG. 13 (*b*) is a graphical representation showing the hardness at different points from the center based on the table of FIG. 13 (*a*) and FIG. 13 (*c*) is a graphical representation showing the hardness at different depths from the surface based on the table of FIG. 13 (*a*).
Figure 13:
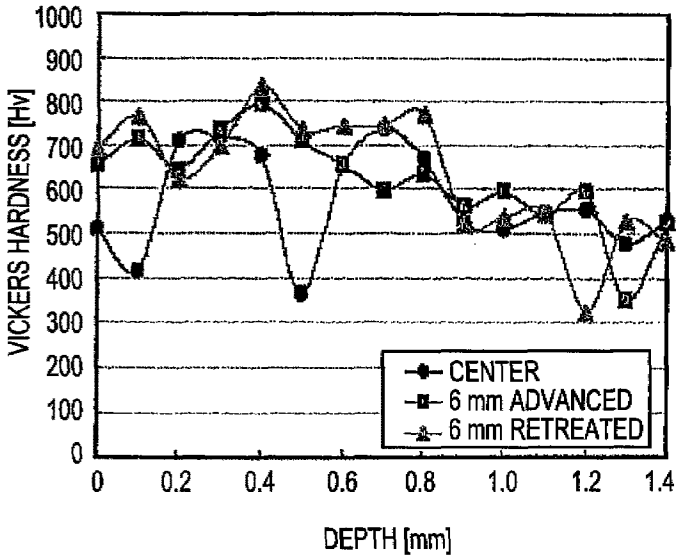
Figure 14A:
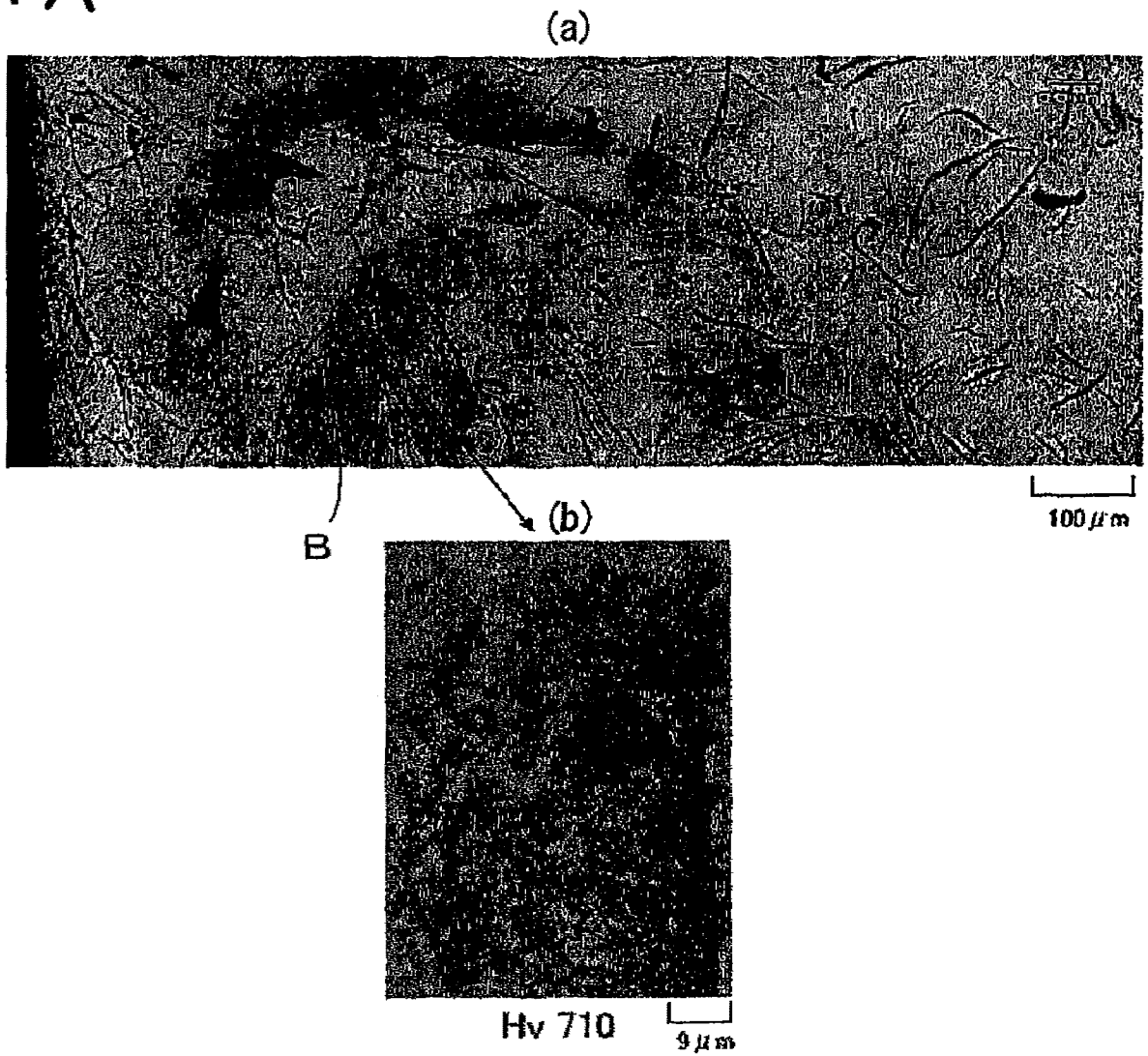
FIG. 14A (*a*) is a microphotograph showing the structure of an object to be hardened after the hardening treatment according to the fifth embodiment of the present invention in a vertical cross-section at a 6-mm advanced point from the center of a stirred portion and FIG. 14A (*b*) is an enlarged microphotograph of the structure at a point B in FIG. 14A (*a*).
Figure 14B:
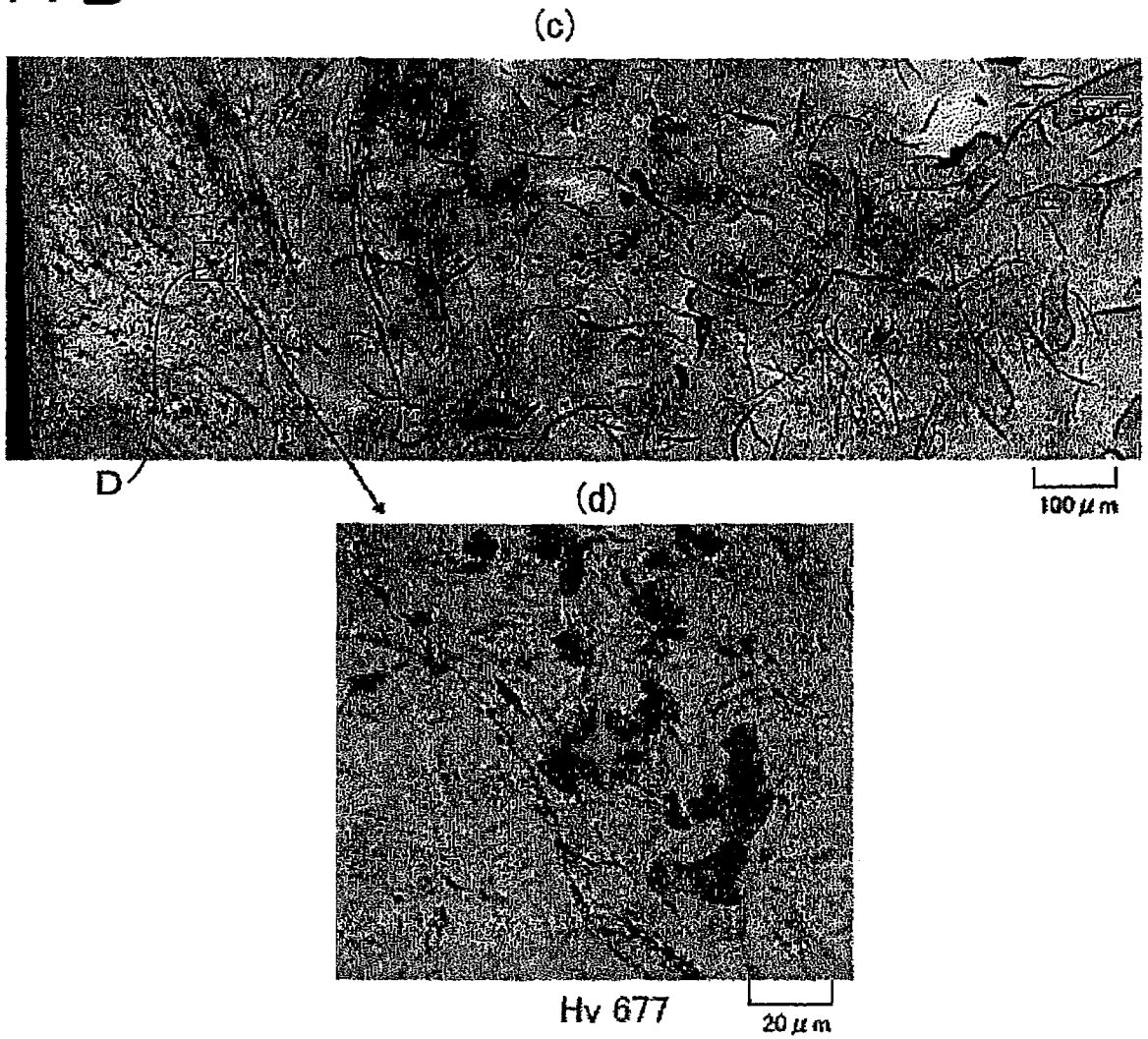
FIG. 14B (*c*) is a microphotograph showing the structure of an object to be hardened after the hardening treatment according to the fifth embodiment of the present invention in a vertical cross-section at the center of a stirred portion and FIG. 14B (*d*) is an enlarged microphotograph of the structure at a point D in FIG. 14B (*c*).

Hardening treatment was implemented on the same object under the same conditions as in the fourth embodiment. However, the hardness was measured in the vicinity of a cross-section (2) in FIG. 10. The hardness (Hv) of the object after being subject to the hardening treatment in the fifth embodiment is shown in FIG. 13 (*a*) to (*c*). The micro structure of the object after being subject to the hardening treatment is shown in the microphotographs of FIG. 14A (*a*) and (*b*) and FIG. 14B (*c*) and (*d*).

The hardness (Hv) of the object after being subject to the hardening treatment in the vicinity of a cross-section (2) in FIG. 10 is shown in FIG. 13 (*a*) to (*c*). The hardness varies between the lowest value of 226.6 Hv at a point 10 mm retreated in the cross-section (2) and 0.8 mm deep from the surface and the highest value of 869.6 Hv at a point 8 mm advanced in the cross-section (2) and 0.2 mm deep from the surface.

Even under such variance of the hardness, the object 1 had a hardness of 600 to 860 Hv except for the surface portion (0 to 0.2 mm) and the vicinity of the center of the pressurizing tool 2. The effect of modification has been recognized.

SIXTH EMBODIMENT

Figure 15:
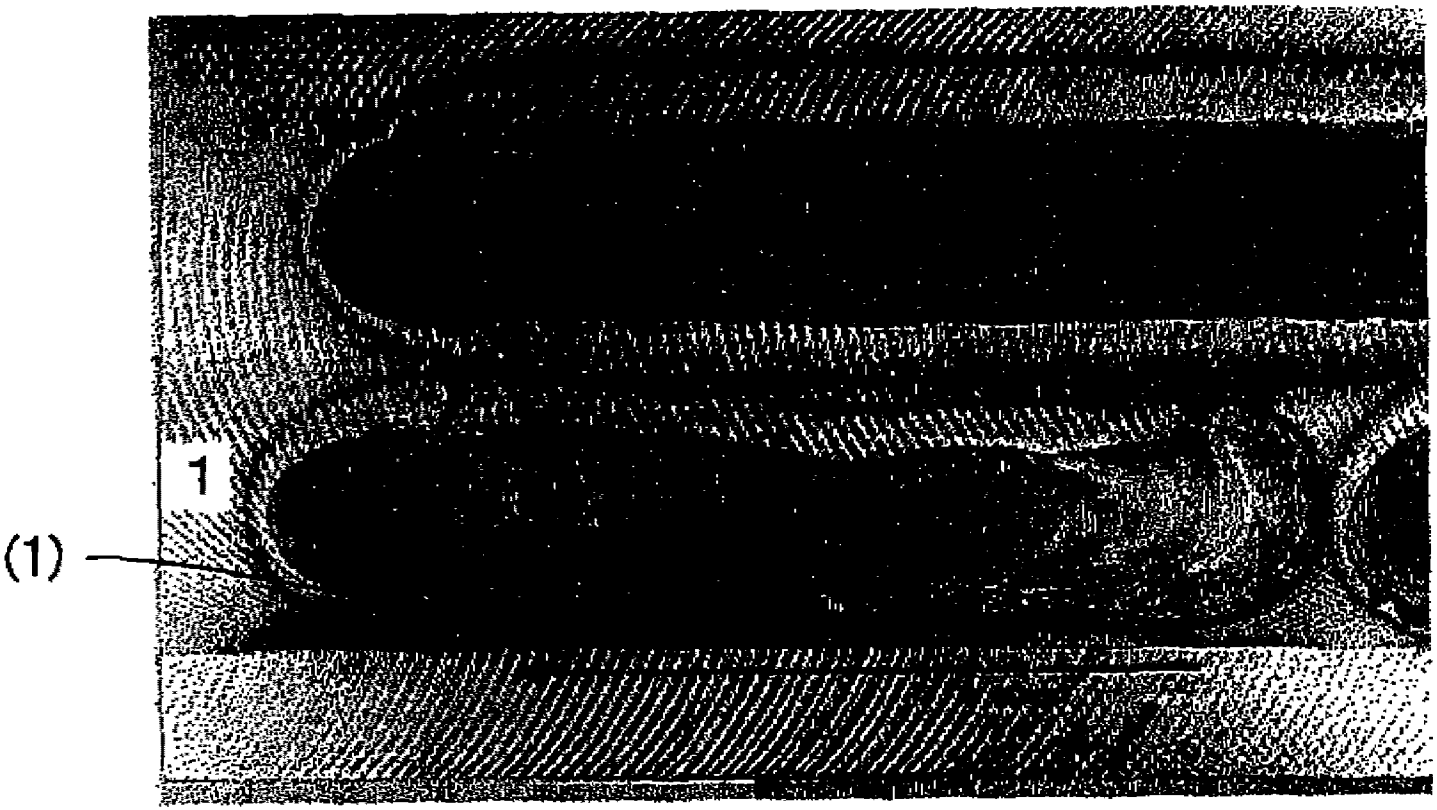
FIG. 15 is a photograph showing the surface of an object to be hardened after the hardening treatment according to the sixth embodiment of the present invention seen from above.

The surface hardening treatment was implemented on a quenched steel HMD (brand name of Hitachi Metal) in the sixth embodiment using the apparatus shown in FIG. 1 (*a*). The results of the surface hardening treatment are shown in 1 of FIG. 15 showing the surface condition of the object after being subject to the hardening treatment, FIG. 16 (*a*) to (*c*) showing the hardness (Hv) of the object after being subject of the hardening treatment, and FIGS. 17A (*a*) and (*b*) and FIGS. 17B (*c*) and (*d*) that are microphotographs each showing the micro structure of the object after being subject to the hardening treatment. Here, the base material of the object has a hardness of 222 to 247 Hv.

The pressurizing was implemented in the sixth embodiment with the pressurizing tool 2 under the following conditions.

Diameter: 25 mm (no probe)
Material: tungsten carbide
Pressure: 2,000 to 3,000 Kg
Rotation speed: 900 rpm
Moving speed: 50 mm/min The initial pressure and rotation speed were 2,000 Kg and 900 rpm, respectively. The pressure was gradually increased while the same rotation speed was maintained. The pressure was 3,600 Kg and the rotation speed was 800 rpm in a cross-section (1) in FIG. 15.

Figure 16:
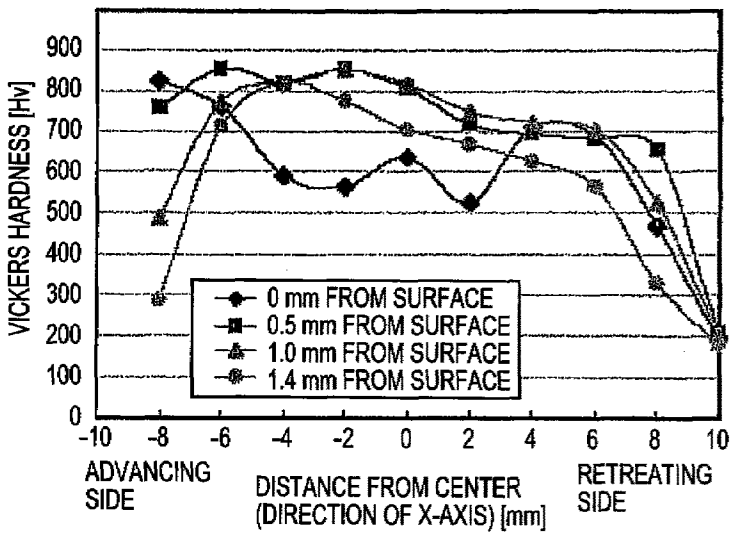
FIG. 16 (*a*) is a table showing the hardness at specific points of an object to be hardened after the hardening treatment according to the sixth embodiment of the present invention, FIG. 16 (*b*) is a graphical representation showing the hardness at different points from the center based on the table of FIG. 16 (*a*) and FIG. 16 (*c*) is a graphical representation showing the hardness at different depths from the surface based on the table of FIG. 16 (*a*).
Figure 16:
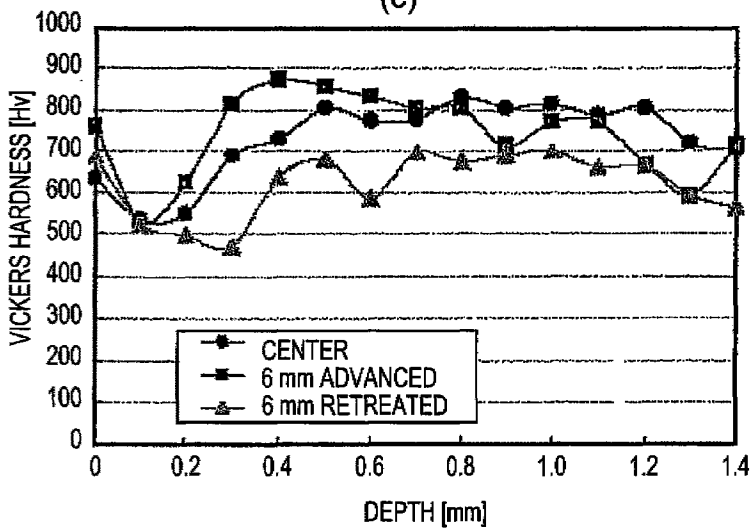
Figure 17A:
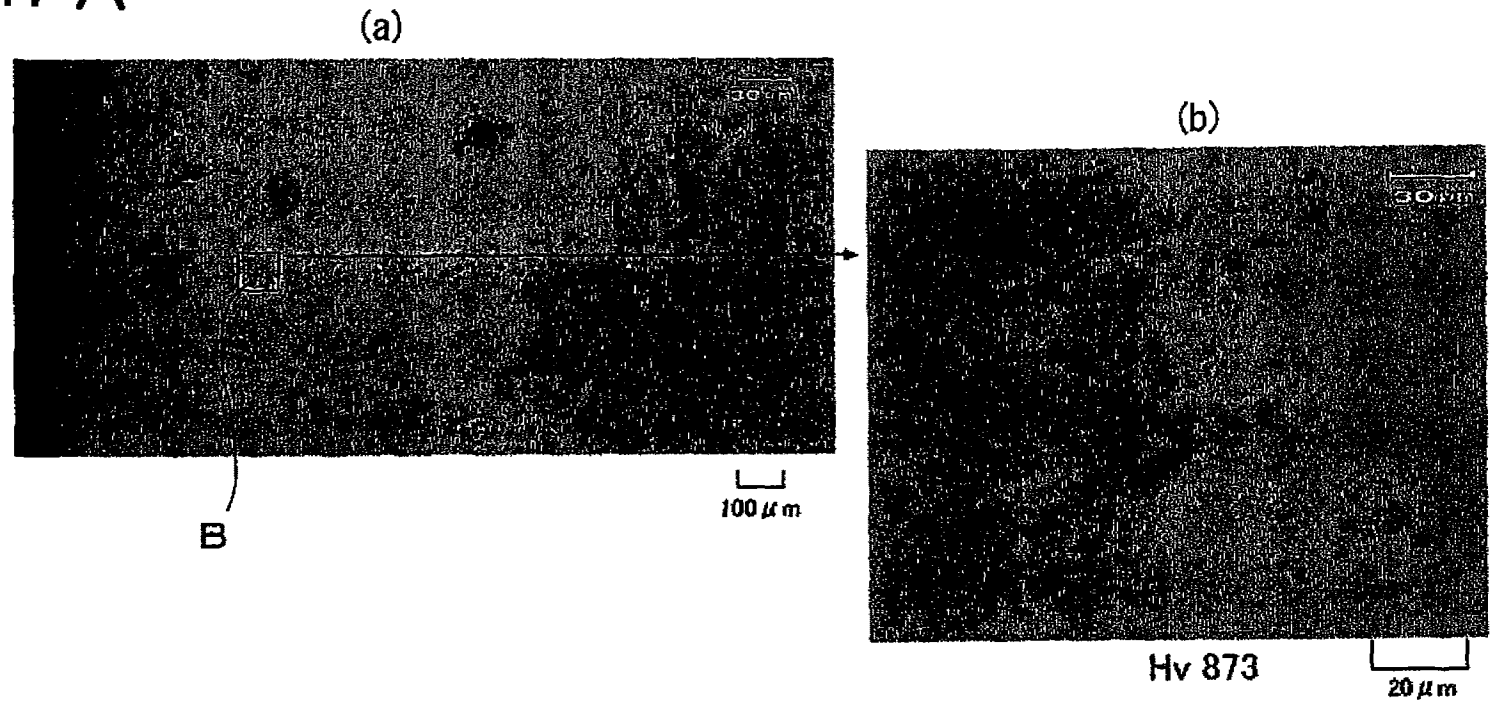
FIG. 17A (*a*) is a microphotograph showing the structure of an object to be hardened after the hardening treatment according to the sixth embodiment of the present invention in a vertical cross-section at a 6-mm advanced point from the center of a stirred portion and FIG. 17A (*b*) is an enlarged microphotograph of the structure at a point B in FIG. 17A (*a*).
Figure 17B:
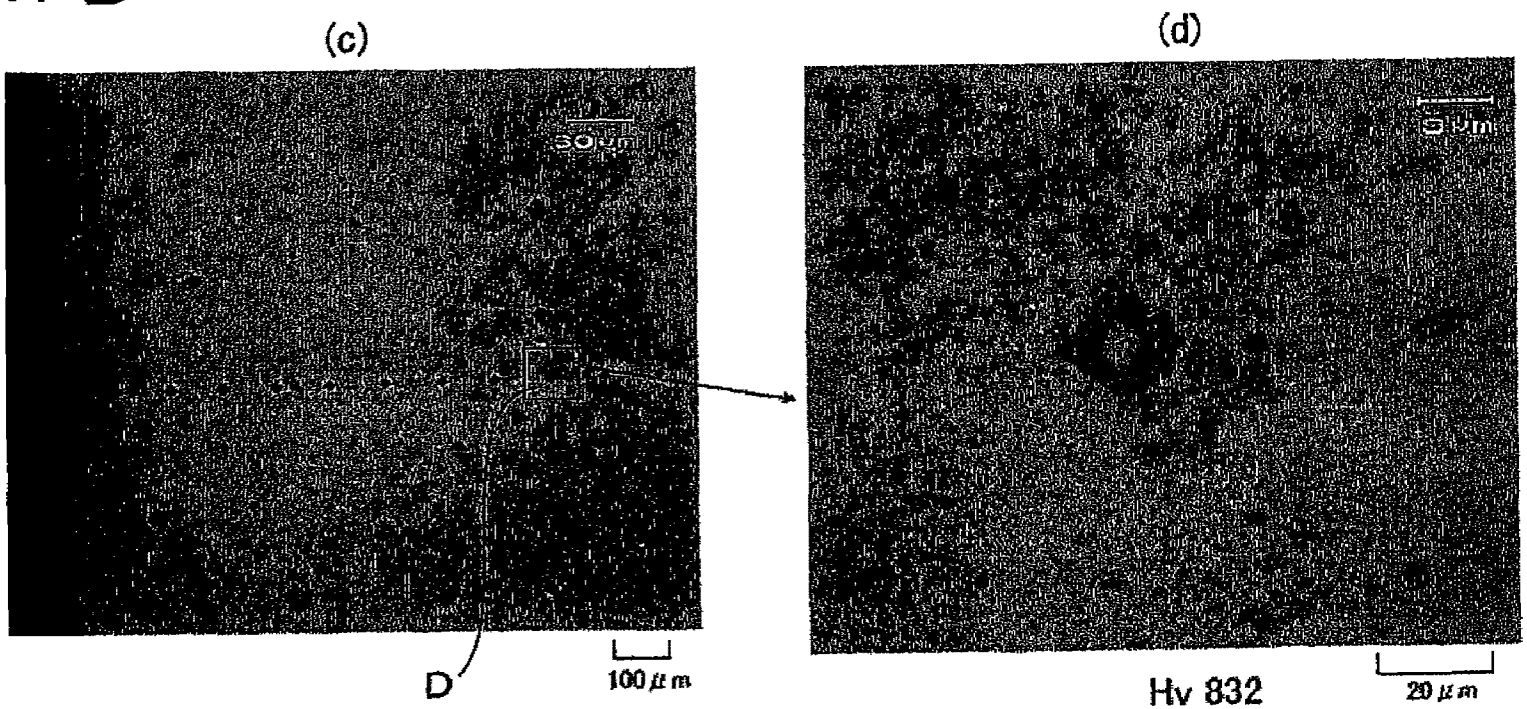
FIG. 17B (*c*) is a microphotograph showing the structure of an object to be hardened after the hardening treatment according to the sixth embodiment of the present invention in a vertical cross-section at the center of a stirred portion and FIG. 17B (*d*) is an enlarged microphotograph of the structure at a point D in FIG. 17B (*c*).

The hardness (Hv) of the object after being subject to the hardening treatment in the vicinity of a cross-section (1) in FIG. 15 is shown in FIG. 16 (*a*) to (*c*). The hardness varies between the lowest value of 179.9 Hv at a point 10 mm retreated in the cross-section (1) and 1.4 mm deep from the surface and the highest value of 873.8 Hv at a point 6 mm advanced in the cross-section (1) and 0.4 mm deep from the surface.

This quenched steel had a hardness of 600 to 870 Hv on an average regardless of the surface of the object 1 and the vicinity of the center of the pressurizing tool 2. Higher effect of modification was recognized. In this way, the surface hardening method of the present invention yields the same effect as on the cast iron regardless of the form of graphite.

FIG. 18 is a table showing Rockwell hardness of the objects after having been subject to the surface hardening treatment in the first to the sixth embodiments. A tester of Rockwell hardness uses a steel ball for measurement and therefore subtle points in a cross-section of the object cannot be measured unlike a tester of Vickers hardness using a measuring needle. This table shows the surface hardness of the objects after being subject to the surface hardening treatment in the first to the sixth embodiments. More specifically, the table shows the hardness of different objects at different advanced or retreated measuring points (in terms of different distances (in mm) from the center of the pressurizing tool).

Analyzing the results of the first to the sixth embodiments, there is a common finding that graphite grains are caused to spread due to refinement of crystal and it is assumed that the measuring needle may have hit against the graphite grains, but not against the martensite structure at measurement of hardness, as this is likely to be understood from the fact that steel containing no graphite (HMD) does not have soft spots. The surface portion (0 to 0.2 mm deep in the embodiments of the present invention) consists of a relatively soft structure and the portion below the surface portion consists of an ideal martensite structure of fine crystal grains caused by pressurizing and heating/cooling.

Furthermore, a hardness close to a desired hardness could be obtained except for the surface portion and the vicinity of the center (up to the points 2 mm advanced or retreated from the center) of the pressurized and stirred portion of the object 1. Comparing the hardness at the advancing side and the retreating side in the pressurized and stirred portion of the object 1, the hardness at the advancing side is higher than that at the retreating side. This is presumably because there is larger influence of the plastic flow due to stirring action on the retreating side.

The surface hardening method of the present invention involving stirring causes the surface portion of the object (o to 0.2 mm deep in the embodiments of the present invention) to be of a relatively soft structure. This advantageously facilitates machining to scrape off burr or roughness to smooth the surface.

The above description is given simply for the purpose of exemplification of the present invention. The present invention is not restricted thereto. Many other various modifications and changes to the present invention can easily be anticipated by a skilled person in the field without departing from the scope of the present invention.

INDUSTRIAL APPLICABILITY

The surface of an object to be hardened can quickly and uniformly be quenched to a desired hardness (approximately 900 Hv) with no special skill or expensive equipment of facility. Furthermore, the object has much less distortion or deformation after being subject to the surface hardening treatment and therefore the present invention is significantly useful in surface hardening treatment of industrial products such as press dies and slide members of machining tools.

The invention claimed is:

1. A transformable metal surface hardening method comprising the steps of:

rotating a nearly cylindrical pressurizing tool at a high speed and pressing a bottom surface thereof slightly into the surface of an object to be hardened with a specific pressure so as to generate local frictional heat between said pressurizing tool and said object, wherein said object to be hardened has a base material including at least 30% of a perlite structure;

causing transformation to a fine martensitic structure in a portion of said object to be hardened that receives the frictional heat; and moving said pressurizing tool at a specific speed when the surface of the object in the vicinity of said pressurizing tool starts to soften because of the frictional heat;

wherein said frictional heat provides an input heat quantity amounting to the melting temperature of said object multiplied by 0.5 (Kelvin) or larger and said object has a surface temperature of 850 to 1,050° C.

2. The surface hardening method according to claim 1, further comprising adjusting the hardness of said object by controlling the input heat quantity Q (W) from the frictional heat based on $Q=4/3\pi^2\mu PNR^3/V$ (here, μ is coefficient of friction, P is pressure applied by the pressurizing tool, N is rotation speed of the pressurizing tool, R is diameter of the pressurizing tool, and V is moving speed of the pressurizing tool).

3. The surface hardening method according to claim 2, wherein the hardness of said object after a surface hardening treatment is 500 to 930 Hv, provided that pressure applied by said pressurizing tool is 1,000 to 6,000 Kg, rotation speed of said pressurizing tool is 400 to 1500 rpm, diameter of said pressurizing tool is 25 mm, and moving speed of said pressurizing tool is 40 to 500 mm/min.

4. The surface hardening method according to claim 3, wherein the pressure applied by said pressurizing tool is gradually increased.

5. The surface hardening method according to claim 1, further comprising adjusting the hardness of said object by controlling the input heat quantity from the frictional heat based on p=V/N (here, p is rotation pitch of the pressurizing tool, V is moving speed of the pressurizing tool, and N is rotation speed of the pressurizing tool).

6. The surface hardening method according to claim 1, wherein said pressurizing tool has a bulged bottom surface.

7. The surface hardening method according to claim 1, wherein said pressurizing tool has a recessed bottom surface.

8. The surface hardening method according to claim 1, wherein said pressurizing tool is made of a metal of high melting point or ceramic having a hardness higher than that of the object to be hardened.

9. The surface hardening method according to claim 8, wherein the metal of high melting point used for said pressurizing tool is one selected from the group consisting of tool steel, tungsten alloy, molybdenum alloy, iridium alloy, and tungsten carbide.

10. The surface hardening method according to claim 8, wherein the ceramic used for said pressurizing tool is PCBN (polycrystalline cubic boron nitride) or silicon nitride.

11. The surface hardening method according to claim 1, wherein said pressurizing tool is oriented in relation to the object in such manner that an angle θ between the bottom surface of said pressurizing tool and the object surface is 0°.

12. The surface hardening method according to claim 1, wherein said pressurizing tool is tilted with the bottom surface raised in a front in a moving direction in such manner that an angle θ between the bottom surface of said pressurizing tool and the object surface is in a range from 0.5° to 10°.

13. A transformable metal surface hardening method comprising the steps of:

rotating a nearly cylindrical pressurizing tool at a high speed and pressing a bottom surface thereof slightly into the surface of an object to be hardened with a specific pressure so as to generate local frictional heat between said pressurizing tool and said object and stir the surface of said object, wherein said object to be hardened has a base material including at least 30% of a perlite structure;

causing transformation to a fine martensitic structure and plastic flow in a portion of said object that receives the frictional heat; and moving said pressurizing tool at a specific speed when the surface of the object in the vicinity of said pressurizing tool starts to soften because of the frictional heat;

wherein said frictional heat provides an input heat quantity amounting to the melting temperature of said object multiplied by 0.5 (Kelvin) or larger and said object has a surface temperature of 850 to 1,050° C.

14. The surface hardening method according to claim 13, wherein the hardness of said object is lower in a stirred surface portion than in a portion below said stirred surface portion.

15. The surface hardening method according to claim 14, wherein said stirred surface portion is scraped off by machining.

* * * * *